United States Patent [19]

Sheahan

[11] 4,427,974

[45] Jan. 24, 1984

[54] LOCAL CONTROL APPARATUS FOR CENTRAL STATION ALARM SYSTEM

[75] Inventor: Robert F. Sheahan, Staten Island, N.Y.

[73] Assignee: American District Telegraph Company, Jersey City, N.J.

[21] Appl. No.: 409,181

[22] Filed: Aug. 18, 1982

[51] Int. Cl.[3] ..... G08B 29/00

[52] U.S. Cl. ..... 340/539; 340/506; 340/508; 340/510; 340/517; 340/518; 340/527; 340/528; 340/333; 340/825.06; 340/825.1; 340/825.31; 179/5 R

[58] Field of Search ..... 340/539, 506, 507, 508–511, 340/517, 518, 505, 521, 502–504, 522, 536–538, 635, 636, 693, 660–663, 541, 577, 584, 587, 588, 825.05, 825.06, 825.1–825.13, 825.31, 825.32, 333; 179/5 R, 5 P

[56] References Cited

U.S. PATENT DOCUMENTS

| | | | |
|---|---|---|---|
| 3,408,642 | 10/1968 | Palladino | 340/543 |
| 3,544,987 | 12/1970 | McMann, Jr. et al. | 340/539 |
| 3,881,171 | 4/1975 | Moorman et al. | 340/542 |
| 3,927,404 | 12/1975 | Cooper | 340/506 |
| 3,940,739 | 2/1976 | Quimet | 340/518 |
| 3,958,240 | 5/1976 | Richardson, III | 340/506 |
| 3,974,489 | 8/1976 | Bleeker | 340/506 |
| 3,978,478 | 8/1976 | Schmitz | 340/506 |
| 4,012,727 | 3/1977 | Grossi et al. | 340/502 |
| 4,021,796 | 5/1977 | Fawcett, Jr. et al. | 340/500 |
| 4,048,620 | 9/1977 | Crandall et al. | 340/825.45 |
| 4,048,621 | 9/1977 | Conklin et al. | 340/825.45 |
| 4,088,983 | 5/1978 | Crandall | 340/505 |
| 4,095,739 | 6/1978 | Fox et al. | 340/51 |
| 4,114,147 | 9/1978 | Hile | 340/528 |
| 4,161,721 | 7/1979 | Conklin et al. | 340/825.3 |
| 4,162,488 | 7/1979 | Silverman et al. | 340/505 |
| 4,189,719 | 2/1980 | Massa et al. | 340/501 |
| 4,206,449 | 6/1980 | Galvin et al. | 340/505 |
| 4,216,375 | 8/1980 | Ulch et al. | 235/382 |
| 4,228,424 | 10/1980 | Le Nay et al. | 340/506 |

*Primary Examiner*—Donnie L. Crosland

*Attorney, Agent, or Firm*—Robert R. Jackson; Charles B. Smith

[57] ABSTRACT

In a central station alarm system the alarm sensors associated with a particular subscriber's premises are monitored by a local control unit associated with those premises and controllable by the subscriber. The local control unit automatically reminds the subscriber when he is supposed to close the premises and turn on the system. The local control unit allows the subscriber to change his expected closing time. The local control unit may also perform various other functions such as automatically cutting off power to low priority alarm sensors during a prolonged power failure, automatically cancelling any audible alarm indication silence commands when there are no alarms to silence, and automatically forming a bridge connection between the remote ends of two communication circuits when there is a break in either circuit.

3 Claims, 8 Drawing Figures

LOCAL CONTROL APPARATUS FOR CENTRAL STATION ALARM SYSTEM

REFERENCE TO MICROFICHE APPENDIX

A microfiche appendix, comprising 3 microfiche having a total number of 178 frames, is a part of this specification.

BACKGROUND OF THE INVENTION

This invention relates to central station alarm systems, and more particularly to local control apparatus which monitors a plurality of alarm sensors and transmits selected alarm signals to a central station.

The trend in central station alarm systems is toward the use of more powerful and versatile local control units. The local control unit in such systems is typically located on the subscriber's premises and is connected to various alarm sensors (e.g., smoke detectors, heat sensors, motion sensors, entry detectors on doors and windows, water flow detectors, etc.) distributed throughout the protected premises. The local control unit monitors signals from the alarm sensors and transmits appropriate alarm signals to a remotely located central station. Operators at the central station interpret the alarm signals received at the central station and dispatch services (e.g., police, fire, or maintenance services and the like) to the subscriber's premises on the basis of the received alarm signals.

More sophisticated local control units are desirable for many reasons. A more sophisticated local control unit allows more functions to be controlled locally, thereby reducing the amount of information which must be transmitted to the central station. This increases the efficiency and lowers the operating cost of the central station because the central station operators have less information to deal with. A more sophisticated local control unit also enhances the level of protection afforded by the system because it provides better monitoring of the alarm sensors and is better able to distinguish true alarm conditions from false alarm conditions. This greatly reduces the transmission of false alarms to the central station. A more sophisticated local control unit also allows the subscriber to have much greater control over his installation without needing to interact with the central station personnel. Other advantages of advanced local control units for central station alarm systems are well known to those skilled in the art.

One of the operating difficulties in many central station alarm systems has been that subscribers frequently wish to change the time at the end of the day at which they intend to close their premises. In many systems the subscriber must telephone the central station to report a change in closing time so that the central station operators will know how to interpret signals received before and after that time. This restricts the subscriber and creates a large volume of telephone traffic for the central station. In addition, should the subscriber fail to contact the central station, operators at the central station must spend a large amount of time to contact the subscriber to obtain the new schedule or inform the subscriber that he failed to secure the premises.

It is therefore an object of this invention to provide a local control unit which eliminates the need for the subscriber to call the central station whenever he wishes to change his closing time.

Local control unit apparatus frequently includes a battery to supply power in the event that the primary alternating current ("AC") power supply fails or is interrupted. If the system has both security and fire alarm sensors, it is desirable to conserve battery power to operate the fire alarm sensors as long as possible during an AC power failure.

It is therefore another object of this invention to provide a local control unit which automatically operates to cut off power to non-fire alarm sensors during a prolonged AC power failure or when remaining battery power is low in order to conserve battery power for the longest possible continued operation of the fire alarm sensors.

Local control unit apparatus also desirably includes means for allowing an authorized operator of the local control unit to silence audible security and fire alarm indications. However, the danger exists when this capability is provided that, once activated, the silencing mechanism will be inadvertently left activated too long and prevent audible indications of a new security or fire alarm indication.

It is therefore yet another object of this invention to provide a local control unit which automatically overrides the silence mechanism when any new alarm condition is detected and which automatically deactivates the silence mechanism entirely when all alarm conditions have been corrected.

Alarm systems having a plurality of distributed alarm monitoring devices typically include two or more communication circuits extending from the control circuitry. The alarm monitoring devices are distributed along these communication circuits. If a break occurs in a communication circuit, it becomes impossible to receive alarms from the alarm monitoring devices beyond the break.

It is therefore still another object of this invention to provide a distributed alarm system in which an alternate circuit can be established when needed for communication with alarm monitoring devices beyond a break in a communication circuit.

SUMMARY OF THE INVENTION

These and other objects of the invention are accomplished in accordance with the invention by providing a local control unit associated with the protected premises, the local control unit comprising first means for detecting opening of the protected premises by an authorized operator, second means for detecting closing of the protected premises by an authorized operator, third means responsive to the first and second means for transmitting an alarm signal to a central station if the second means does not detect closing of the protected premises within a first predetermined time interval after the first means detects opening of the protected premises, fourth means responsive to the second and third means for producing a first output indication detectable by the authorized operator a second predetermined time interval before the end of the first time interval if the second means has not yet detected closing of the protected premises, and fifth means responsive to the third means for allowing the authorized operator to optionally extend the first time interval prior to transmission of the alarm signal by the third means.

The local control unit of this invention may also include a battery for supplying power to the apparatus in the event of failure of the primary alternating current power supply, means for monitoring the alternating current power to detect failure of that power supply, and means for automatically turning off power to the non-fire alarm sensors connected to the local control unit when the alternating current has been off for a predetermined length of time in order to conserve remaining battery power for continued operation of the fire alarm sensors and of the system in the event of a fire emergency.

Another feature which may be provided in the local control unit of this invention includes an alarm silence latch settable by the operator of the local control unit for suppressing an audible alarm warning when the latch is set, and means for automatically resetting the alarm silence latch if none of the alarm sensors connected to the local control unit is indicating an alarm condition.

The alarm system of this invention may also include bridge means for selectively connecting together the remote ends of two communication circuits extending from the local control unit so that if a break occurs in either communication circuit, communication can be re-established with alarm monitoring devices beyond the break via the other communication circuit and the bridge connection between the ends of the two circuits.

Further features of the invention, its nature and various advantages will be more apparent from the accompanying drawing and the following detailed description of the invention.

DETAILED DESCRIPTION OF THE INVENTION

Figure 1:
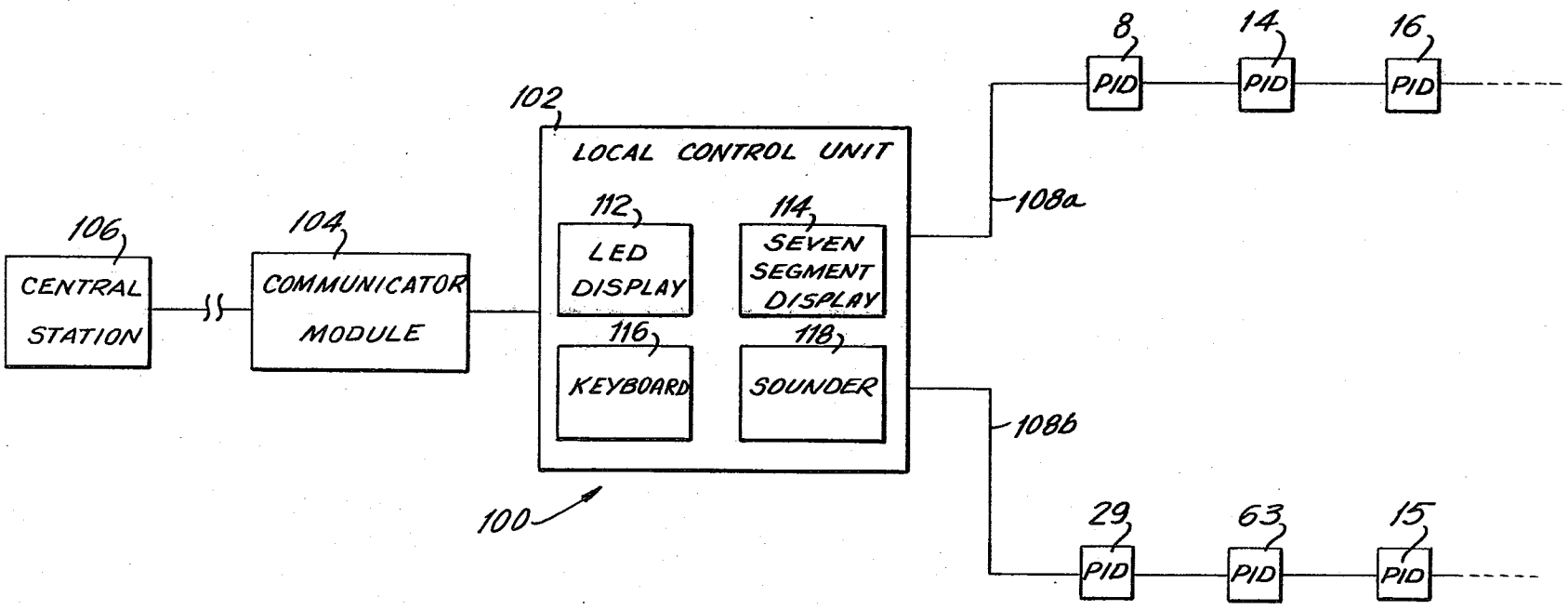
FIG. 1 is a block diagram of a typical central station system including the local control unit of this invention.

As shown in FIG. 1, the local control unit 102 of this invention is typically used in a central station alarm system 100 including a plurality of point interface devices ("PIDs") monitored and/or controlled by control unit 102, and a communicator module 104 connected to control unit 102 for allowing the control unit to communicate with a remotely located central station 106. Typically, the PIDs and elements 102 and 104 are located on the premises protected by the system, while central station 106 is located a substantial distance away from the protected premises.

The PIDs are typically distributed throughout the protected premises, and each PID is connected to a conventional alarm sensor or similar apparatus (not shown). The PIDs are all connected to local control unit 102 by one or two cables 108*a*, 108*b*, which may, if desired, form a single closed loop. The particular embodiment discussed herein can acommodate as many as 64 PIDs, although this number is in no way critical to the invention.

Certain PID numbers are restricted to being of particular types as follows:

TABLE A

| PID No. | Required Type |
|---|---|
| 0–10 | Commandable output PIDs |
| 11–12 | Bridge PIDs |
| 13 | Not used |
| 14 | Remote BA2 keyswitch |
| 15 | Bell PID |
| 16–63 | Ordinary alarm PIDs |

Commandable output PIDs are PIDs which send no data to control unit 102 but which can receive data from the control unit to control a device associated with the PID, e.g., to turn on or turn off a pump associated with the PID. Bridge PIDs are PIDs which can be used to selectively connect cables 108*a*, 108*b* together to form a closed loop (see discussion of FIG. 7 below). The remote BA2 keyswitch PID is a control unit remote from local control unit 102 for allowing part of the burglar alarm system (i.e., the so-called BA2 part of the burglar alarm system) to be turned on or off from the remote location of the BA2 keyswitch PID. The BA2 system is typically associated with a secured area such as a safe or strong room within the primises protected by the remainder of the burglar alarm system (i.e., the so-called BA1 part of the burglar alarm system). The bell PID is the PID which controls the ringing of an alarm bell associated with the protected premises.

Figure 6:
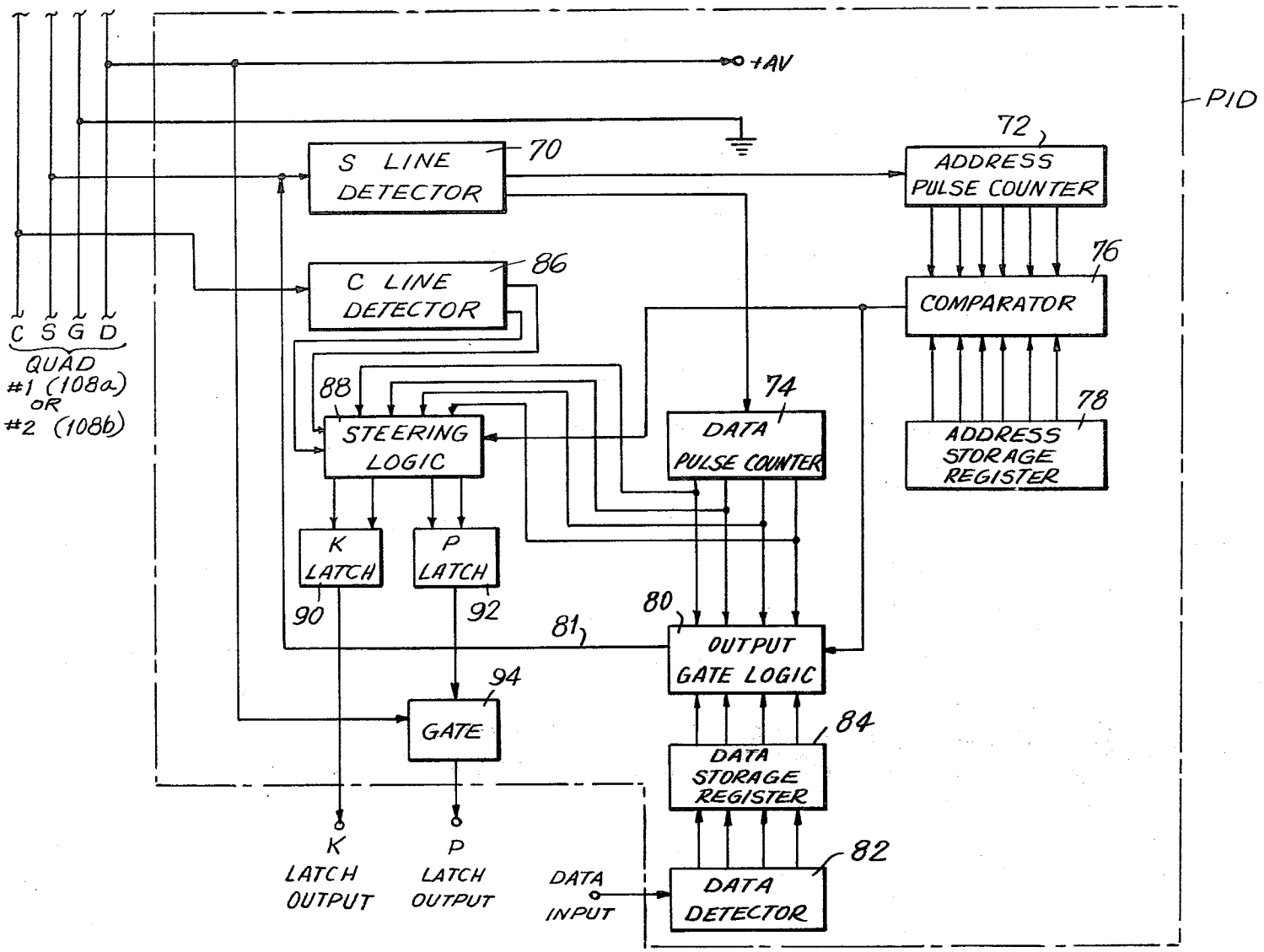
FIG. 6 is a block diagram of a typical point interface device ("PID") for use with the local control unit of this invention.

In FIG. 1, reference numbers 8, 14, 15, 16, 29, and 63 are associated with the representative PIDs shown. These reference numbers correspond to the PID numbers discussed above. Thus PID 8 is a commandable output PID, PID 14 is a remote BA2 keyswitch PID, PID 15 is a bell PID, and PIDs 16, 29, and 63 are typical alarm PIDs. The order and arrangement of the PIDs along cables 108*a*, 108*b* is entirely arbitrary. The construction of a typical PID is shown in FIG. 6 and described in detail below.

There are sixteen types of ordinary alarm PIDs identified in a programmable read-only memory ("PROM") associated with control unit 102 as follows:

TABLE B

| PROM Data | Alarm PID Type |
|---|---|
| 0 | BA1 fixed |
| 1 | BA1 movable instant |
| 2 | BA1 movable delayed |
| 3 | BA1 fixed redundant |
| 4 | BA1 movable instant redundant |
| 5 | BA1 movable delayed redundant |
| 6 | BA2 fixed |
| 7 | BA2 movable instant |
| 8 | BA2 movable delayed |
| 9 | BA2 fixed redundant |
| A | BA2 movable instant redundant |
| B | BA2 movable delayed redundant |
| C | Holdup |
| D | Supervisory |
| E | Fire |
| F | No PID |

A BA1 or BA2 fixed PID is a PID connected to a sensor which monitors a protection point which is normally never opened (e.g., a window foil, a glass breakage sensor, a wire screen, etc.). A fixed PID is active at all times. While the associated BA protection is on, an alarm from a fixed PID is recognized as an alarm. But while the associated BA protection is off, an alarm from a fixed PID is recognized only as a "day trouble".

A BA1 or BA2 movable instant PID is a PID connected to a sensor which monitors a protection point which may be opened (e.g., a door). While the associated BA protection is on, opening of the protection point causes an instantaneous alarm. While the associated BA protection is off, the protection point can be opened without causing any alarm. BA movable instant protection points are monitored at all times for trouble, tamper, and point communications failure.

A BA1 or BA2 movable delayed PID is a PID connected to a sensor which monitors a protection point similar to a movable instant protection point (e.g., a door) but which, when the associated BA protection is on, allows a so-called entry time delay before opening of the protection point is recognized as an alarm. A BA movable delayed protection point is normally associated with a door to the protected premises which is physically near control unit 102 so that the subscriber can enter the premises and turn off the BA protection during the entry time delay interval without causing an alarm. Similarly, the subscriber can turn on the BA protection and leave the protected premises through the movable delayed protection point during an exit time delay interval without causing an alarm. In other respects, movable delayed protection points are identical to movable instant protection points.

BA1 and BA2 fixed redundant, movable instant redundant, and movable delayed redundant PIDs are similar to the corresponding non-redundant PIDs discussed above, except that an alarm from one of these devices is not, by itself, recognized as an alarm by the system. Thus an alarm from one of these so-called redundant PIDs requires a confirming alarm from another PID. Redundant PIDs are therefore typically associated with sensors which are characterized by a relatively high false alarm rate (e.g., ultrasonic motion detectors or window foil).

A holdup PID is a PID associated with a holdup alarm sensor. A supervisory PID is a PID associated with a supervisory sensor (i.e., almost any type of non-burglary, non-holdup, and non-fire sensor such as a sensor for monitoring temperature or pressure in a process). A fire PID is a PID connected to a fire alarm sensor. "No PID" means that there is no PID in the system corresponding to a particular address.

Local control unit 102 includes light emitting diode ("LED") display 112, seven segment display 114, keyboard 116, and audio sounder 118. These elements of control unit 102 are shown in greater detail in FIG. 5. Individually, these elements are all devices of types which are well known to those skilled in the art. LED display 112 includes light emitting diodes numbered as follows and indicating the following conditions:

TABLE C

| LED No. | LED Color | Indicated Condition |
|---|---|---|
| DS1 | Green | Protection on |
| DS2 | Yellow | Common trouble |
| DS3 | Yellow | Communication failure |
| DS4 | Yellow | AC power failure |
| DS5 | Red | Fire alarm |
| DS6 | Red | Security alarm |
| DS7 | Red | Supervisory alarm |
| DS8 | Red | Point communication trouble |
| DS9 | Yellow | Point bypass |
| DS10 | Green | Point relay |
| DS11 | Red | Point tamper |
| DS12 | Red | Point trouble |
| DS13 | Red | Point alarm |

LED DS1 is illuminated when the BA1 system is on. (The BA2 system must be on before the BA1 system can be turned on.) LED DS2 is illuminated when control unit 102 detects any of several problems such as failure of one or both of cables 108*a*, 108*b* or a trouble in a fire alarm PID. LED DS3 is illuminated to indicate that communicator module 104 is having trouble communicating with central station 106 (steady illumination) or to indicate that control unit 102 is having trouble communicating with communicator module 104 (intermittent illumination). LED DS4 is illuminated to indicate that the alternating current ("AC") power has failed. LEDs DS5–DS7 are illuminated to respectively indicate that a fire, security, or supervisory alarm has been detected. LED DS8 is illuminated to indicate that a particular PID is not responding to control unit 102. (The number of the pertinent PID is simultaneously displayed by seven segment display 114.) LED DS9 is illuminated to indicate that a particular PID has been bypassed (i.e., temporarily cut out of the system at the request of the subscriber). (The number of the pertinent PID is simultaneously displayed by seven segment display 114.) LED DS10 is illuminated to indicate that a particular PID is in the "relay on" condition (i.e., that the K latch, discussed below in connection with the C line signals, is set in that PID). (The number of the pertinent PID is simultaneously displayed by seven segment display 114.) LEDs DS11–DS13 are illuminated to respectively indicate that a particular PID is being tampered with, is experiencing trouble, or has detected an alarm. (The number of the pertinent PID is simultaneously displayed by seven segment display 114.)

LED DS14 (not shown) is included in cold water ground detector 374 (FIG. 4), described below. This LED is illuminated to indicate a ground fault (i.e., that the normal connection to earth or cold water ground has been broken or that one of cables 108*a*, 108*b* is short circuited to ground).

Seven segment display 114 includes two seven-segment light emitting diode display devices 114*a*, 114*b* (FIG. 5), each capable of representing a decimal digit. Thus devices 114*a*, 114*b* together can display any two-digit decimal number such as a PID number.

Keyboard 116 (shown in greater detail in FIG. 5) includes 16 buttons for entering decimal digits 0–9 and for requesting the following functions: ON, HOURS, BYPASS, TEST, RESET, and SILENCE. The digits buttons are used principally to allow service personnel and the subscriber's personnel (any of whom are sometimes referred to herein as "authorized operators") to enter multidigit code numbers ("passcodes") for identifying themselves to the system. Entry of a valid passcode while the BA1 protection is on automatically turns the BA1 protection off. Entry of a valid passcode at any time also activates the non-digit buttons on keyboard 116 for a predetermined time period, during which time period the authorized operator can operate those non-digit buttons to command the system to perform various functions. The ON button is used principally to turn the BA1 protection on. The HOURS button is used (in combination with the digit buttons) to enter the number of hours by which the normal closing time is to be extended before the BA1 protection will be turned on. The BYPASS button is principally used (in combination with the digit buttons) to enter the number of a PID to be bypassed, i.e., temporarily cut out of the system so that the BA protection can be turned on even though the bypassed PID may be erroneously signalling an alarm. The TEST button is used (in combination with the digit buttons) to request any of several test modes. The RESET button is used principally to reset control unit 102, e.g., to clear the alarm memories in the control unit. The SILENCE button is used to shut off sounder 118 and any bells or similar audible device in the system.

Sounder 118 is an audio tone generator for generating an audio tone used to alert the subscriber to a variety of conditions (e.g., that the entry time delay interval is running, that a valid subscriber passcode has been entered via keyboard 116, etc.).

Figure 2:
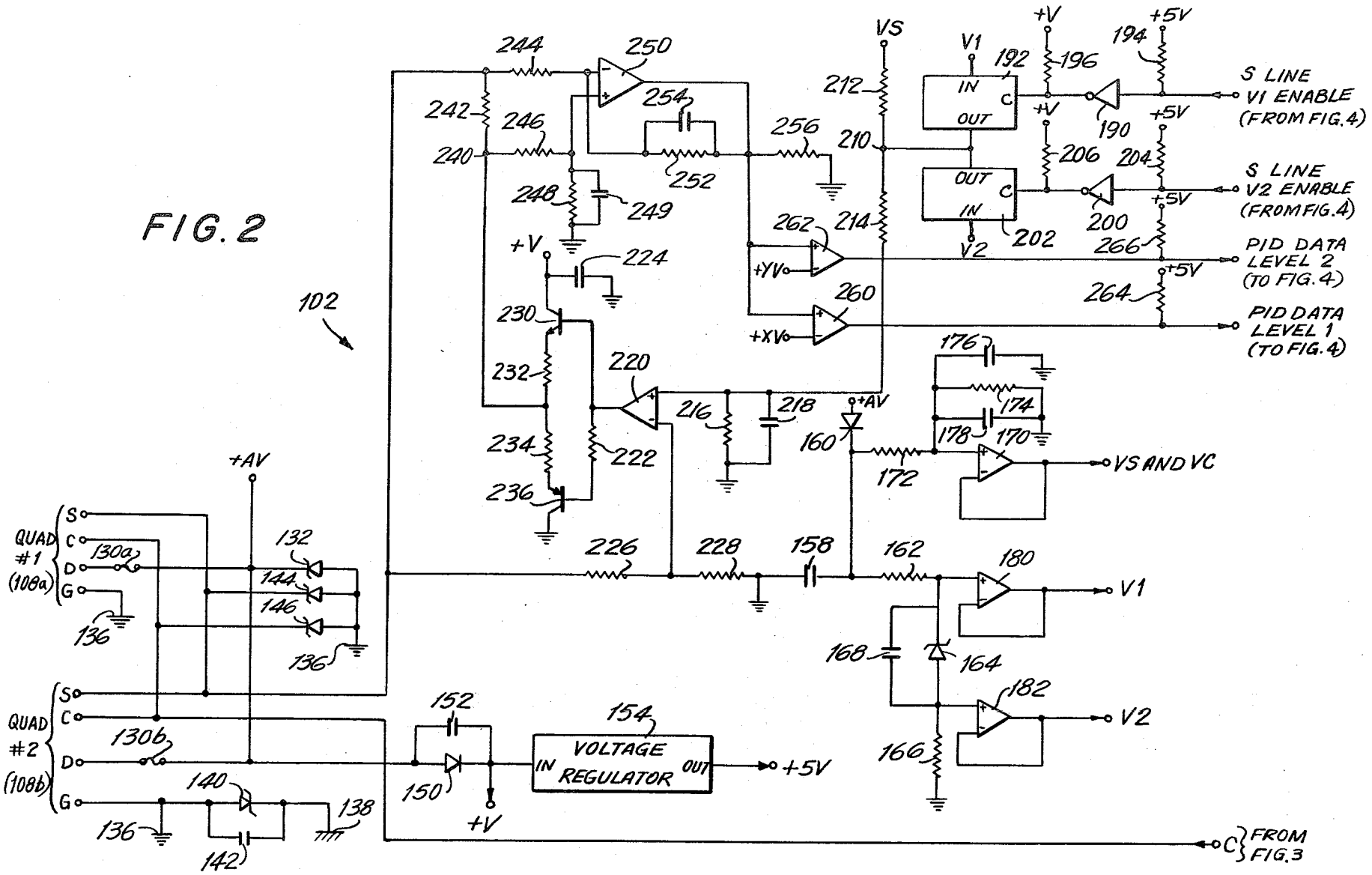
FIG. 2 is a schematic diagram of a portion of the local control unit of this invention.

Considering now the manner in which control unit 102 communicates with the PIDs, each cable 108*a*, 108*b* comprises four wires, known respectively as the S, C, D, and G lines (see FIG. 2). Because these lines each have four wires, they are sometimes referred to as QUADs. In general, the S line is used to select desired PIDs and to receive data from the selected PIDs, the C line is used to transmit so-called relay and power commands to the PIDs, the D line transmits DC power from control unit 102 to the PIDs, and the G line provides a ground connection at control unit 102 for the PIDs.

In the particular embodiment shown in the drawing, S line signalling is accomplished by applying to the S line pulses having voltage V1 and V2, respectively above and below a quiescent S line voltage VS. Similarly, C line signalling is accomplished by applying to the C line pulses having voltage V1 and V2, respectively above and below a quiescent C line voltage VC. Some of the S line pulses are used to address desired PIDs. Other S line pulses are used to monitor the response to the addressed PIDs. Among the PID response data on the S line are the following three data items: (1) whether or not the sensor connected to the PID has detected an alarm condition; (2) whether or not the PID has detected a trouble (e.g., a short circuit) in the associated alarm sensor; and (3) whether or not the PID has detected tampering with the PID. Some of the C line pulses are used to set so-called relay ("K") and power ("P") latches in the addressed PIDs, while other C line pulses are used to reset those latches. Typical uses of the K and P latches mentioned above are to turn on or off a lamp or other device connected to the PID, or to turn on or off a device connected to the PID which uses power supplied by control unit 102 to conserve auxiliary battery power during a prolonged AC power failure.

Further details of the particular S and C line signalling protocol employed are not disclosed here for the following reasons: (1) the particular protocol chosen forms no part of the present invention; (2) the particular protocol employed cannot be revealed without making it possible for unauthorized individuals to compromise or defeat security systems to be installed by the assignee of this invention; and (3) those skilled in the art can readily implement any one of a large number of equivalent protocols which can be employed.

The construction of control unit 102 is shown in more detail in FIGS. 2–5. The four lines of cables 108*a* and 108*b* are respectively connected to the upper and lower groups of terminals S, C, D, and G in FIG. 2. The two D terminals are connected to a source of +A volts (e.g., a conventional direct current ("DC") power supply circuit connected to the commercial AC power network with a rechargeable backup battery for supplying auxiliary power during failure of the commercial AC power). Fuses 130*a*, 130*b* protect the D line circuit from excessive current flow (e.g., due to a short circuit of one or both of the D lines to ground). Surge suppressor 132 (i.e., a commercially available, high speed, Zener-diode-like device) is connected between the D line circuits and local ground 136 to protect the D line circuit from high voltage transients (e.g., due to lightning). The S and C line circuits are similarly protected from high voltage transients by surge suppressors 144 and 146, respectively.

The two G terminals are connected to local ground 136. Local ground 136 is connected to true earth grund or cold water ground 138 via parallel connected surge suppressor 140 and capacitor 142. In this way any transients induced in the system are conducted to cold water ground 138.

Within control unit 102 the source of +A volts is connected across diode 150 and capacitor 152 to a conventional voltage regulator 154 for providing a stable source of +5 volts for powering the digital logic elements described in detail below. The output signal of diode 150 is also used as a source of reference voltage +V which is substantially equal to +A volts minus the small voltage drop due to diode 150. Also within control unit 102 the source of +A volts is connected via diode 160 to circuits for generating three other voltages V1, V2, and VS=VC. These voltages are related to one another as follows: V1>VS=VC>V2.

The circuit for generating VS and VC includes operational amplifier 170 connected between voltage dividing resistors 172 and 174 which are augmented by capacitors 176 and 178. Operational amplifier 170 acts as a unity gain amplifier for assuring that the output of the circuit remains at VS and VC regardless of the load on the output. Capacitor 158 provides a connection to ground which acts as a radio frequency ("RF") bypass filter for the VS, VC, V1, and V2 circuits.

The circuits for generating V1 and V2 are similar to the circuit for generating VS and VC. Series connected resistor 162, Zener diode 164, and resistor 166 (with capacitor 168 in parallel with the Zener diode) form a voltage dividing network. The voltages on opposite sides of Zener diode 164 retain a constant differential despite possible fluctuations in the voltage of the power supply source of +A volts (e.g., due to a drop in backup battery voltage during a prolonged AC power failure). Operational amplifier 180 is connected to one side of Zener diode 164 to produce voltage V1, and operational amplifier 182 is connected to the other side of Zener diode 164 to produce voltage V2. In each case the operational amplifier is connected as a unity gain amplifier to assure that the output signal remains at V1 or V2 regardless of the output load.

Figure 4:
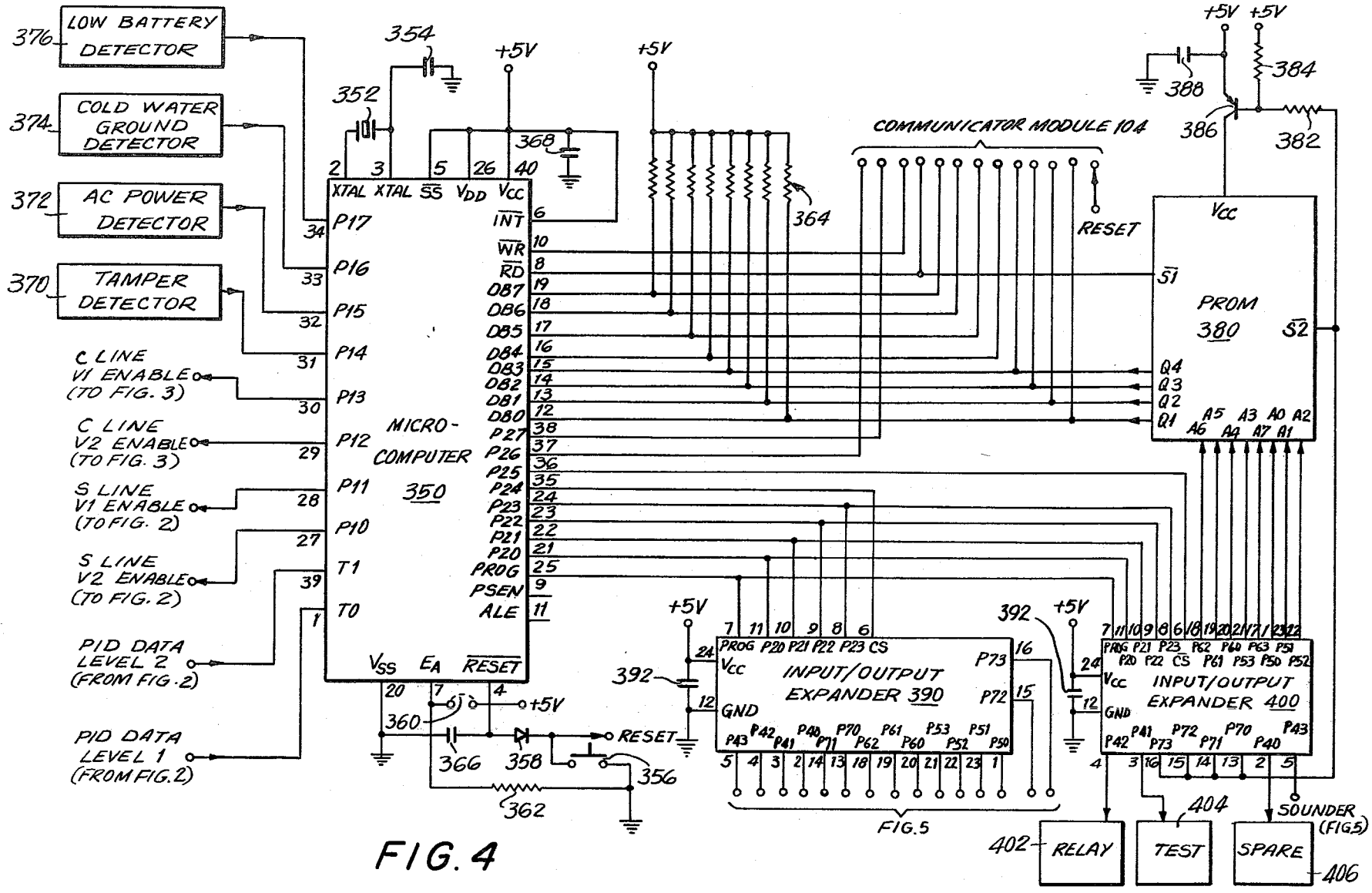
FIG. 4 is a schematic block diagram of yet another portion of the local control unit of this invention.
Figures 4, 5:
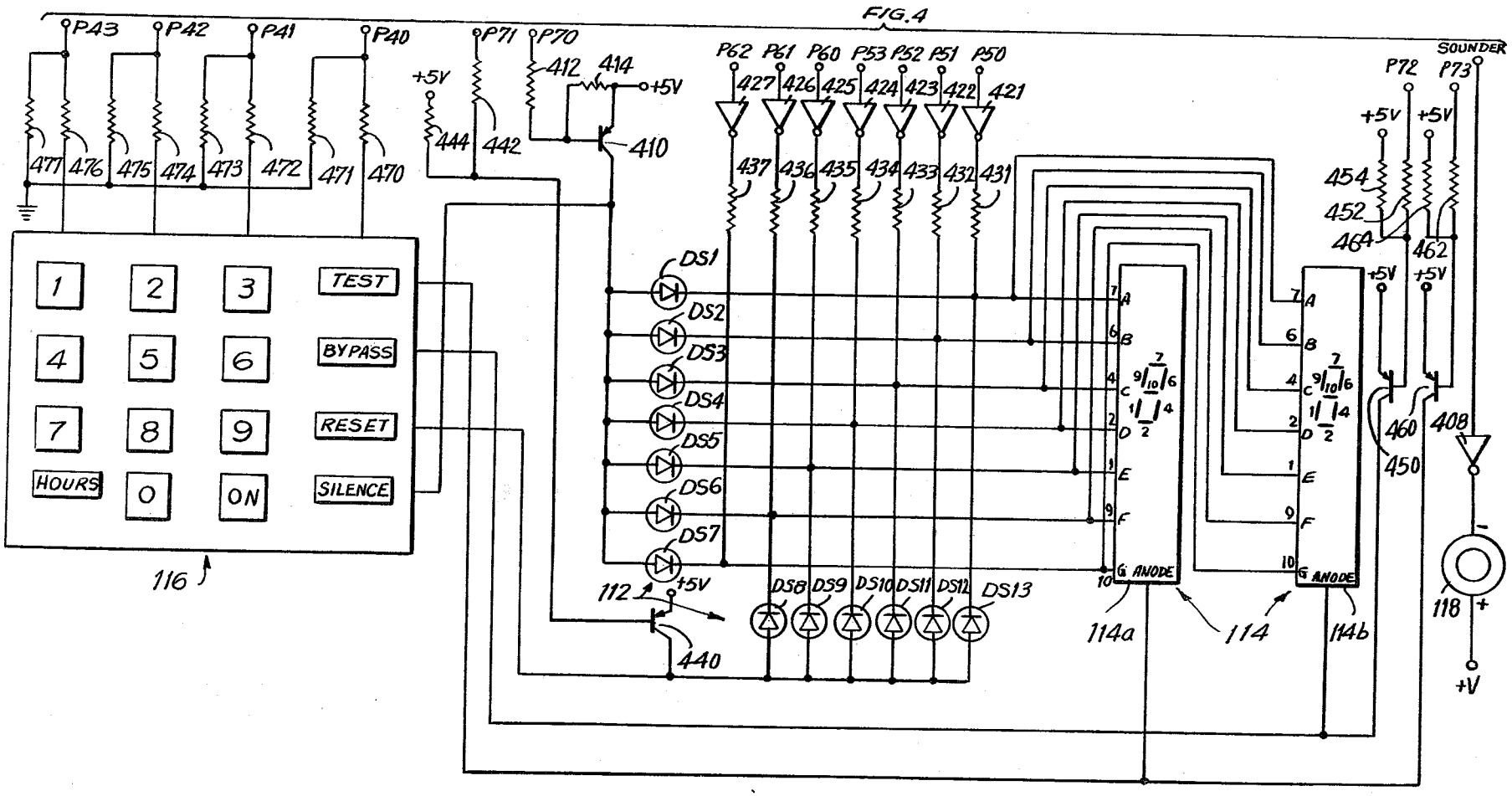
FIG. 5 is a schematic diagram of still another portion of the local control unit of this invention.

The circuit for controlling the S line voltage is ultimately controlled by the S line V1 enable pin 28 and S line V2 enable pin 27 of microcomputer 350 in FIG. 4. The signals on these pins are respectively applied to conventional inverting buffers 190 and 200 in FIG. 2. The output signals of buffers 190, 200 are respectively applied to conventional solid state switches 192, 202. Pull-up resistors 194, 196, 204, 206 assure that sufficient current is available to drive each succeeding element in each of the above-described circuits. Solid state switch 192 connects point 210 to the source of V1 described above when microcomputer 350 signals that a V1 pulse is to be applied to the S line. Similarly, solid state switch 202 connects point 210 to the above-described source of V2 when microcomputer 350 signals that a V2 pulse is to be applied to the S line. Unless thus connected to V1 or V2, point 210 is at voltage VS as a result of resistor 212 connecting that point to the above-described source of VS.

The signal at point 210 is processed by the circuitry connected between points 210 and 240 to amplify the available current without altering the voltage. The signal at point 210 is applied to operational amplifier 220 via resistor 214 in cooperation with resistor 216 and capacitor 218. The output signal of amplifier 220 is connected to a conventional push-pull amplifier circuit including resistor 222, capacitor 224, transistor 230, resistors 232 and 234, and transistor 236. Point 240 is connected to a point intermediate resistors 232 and 234. The signal at point 240 is connected to the S line via resistor 242, and the S line signal is fed back to operational amplifier 220 via resistor 226. The feedback input to operational amplifier 220 is connected to ground via resistor 228. Thus the voltage on the S line is either V1, V2, or VS, depending on whether a V1 pulse, a V2 pulse, or neither is to be transmitted to the PIDs via the S line.

Control unit 102 monitors the current flowing in the S line to detect the data response of the PIDs. This is accomplished by monitoring the voltage drop across resistor 242. The voltages on opposite sides of resistor 242 are applied to the input terminals of operational amplifier 250 via resistors 244 and 246. The point intermediate resistor 246 and operational amplifier 250 is connected to ground via resistor 248 and capacitor 249. The operational amplifier output signal is fed back to the operational amplifier via resistor 252 and capacitor 254. The operational amplifier output signal is also connected to ground via resistor 256 and to one input terminal of conventional comparators 260 and 262. Thus operational amplifier 250 produces an output signal proportional to the voltage drop across resistor 242.

Comparators 260 and 262 each compare the output signal of operational amplifier 250 to a reference signal +X volts or +Y volts to provide a window within which valid PID response data must fall. The output signals of comparators 260 and 262 are respectively applied to pins 1 and 39 of microcomputer 350 in FIG. 4. Pull-up resistors 264, 266 are used to assure that there is sufficient current applied to microcomputer pins 1 and 39.

Figure 3:
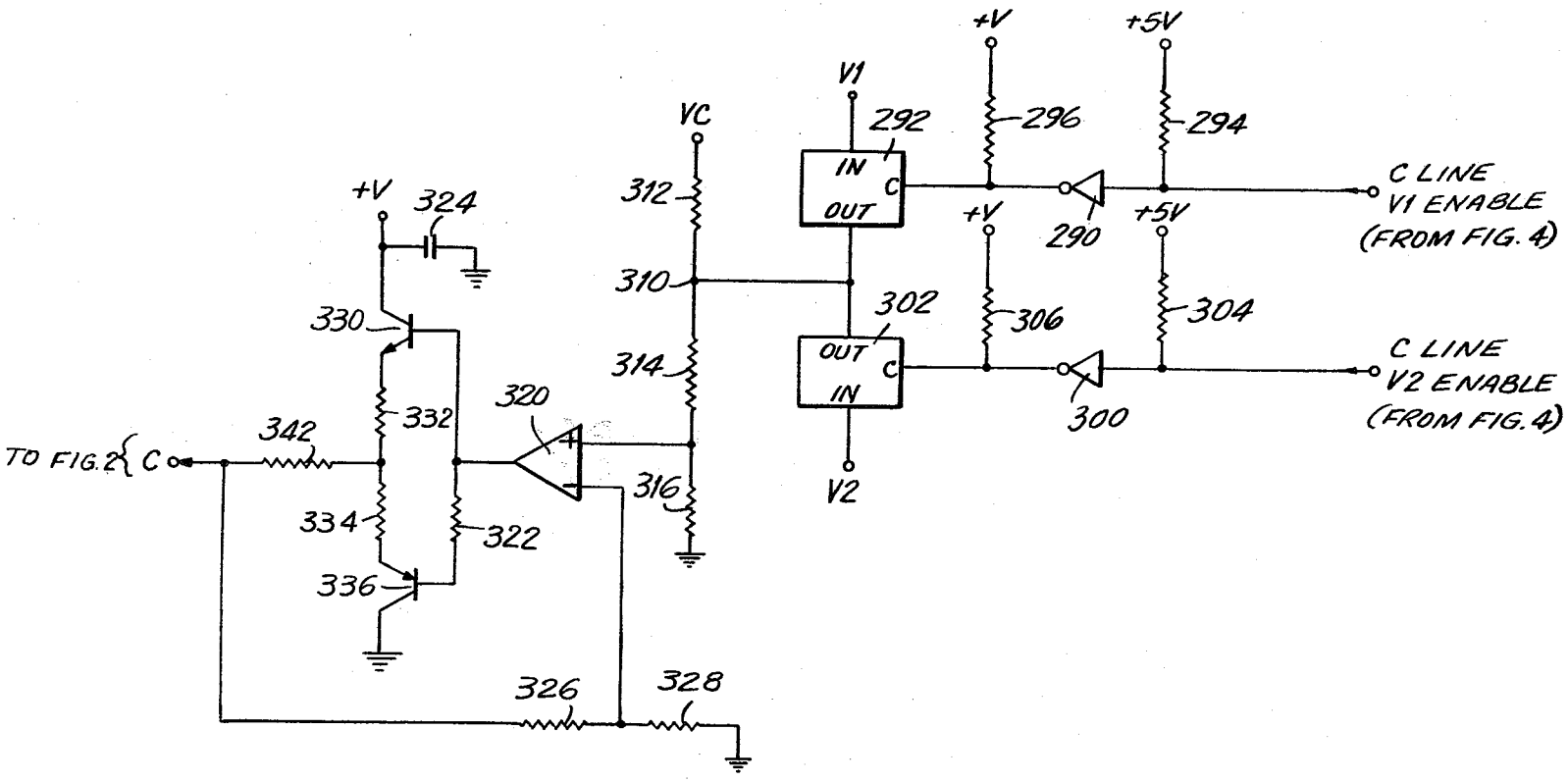
FIG. 3 is a schematic diagram of another portion of the local control unit of this invention.

FIG. 3 shows the circuit for controlling the C line voltage in response to C line V1 enable and C line V2 enable control signals appearing on pins 30 and 29, respectively, of microcomputer 350. The circuit of FIG. 3 is substantially identical to the portion of the FIG. 2 circuit which controls S line voltage. Thus if 100 is subtracted from the reference number for any element in FIG. 3, the resulting number is the reference number of the corresponding element in FIG. 2. For example, inverting buffer 290 in FIG. 3 corresponds to inverting buffer 190 in FIG. 2.

FIG. 4 shows the data processing portion of control unit 102. The principal element of this apparatus is microcomputer 350. Although any suitably programmed microcomputer may be used, in the particular embodiment described in detail herein microcomputer 350 is a model 8050 microcomputer commercially available from National Semiconductor Corporation of Santa Clara, Calif. An illustrative program for microcomputer 350 is set forth in the microfiche appendix to this specification and is discussed in detail below.

Considering first the organization of microcomputer 350, there are 40 input and/or output pins numbered 1–40. Pin 1 is the toggle zero or T0 pin which is connected to the output of comparator 260 in FIG. 2. Pins 2 and 3 are frequency control pins, between which frequency control crystal 352 is connected. Crystal 352 establishes the basic clock frequency of microcomputer 350. Pin 3 is also connected to ground via capacitor 354. Pin 4 is the reset pin which is connected to manual reset switch 356 via diode 358. When reset switch 356 is closed, microcomputer 350 resets and beings its operating routine or program from the start as though it were commencing operation for the first time. Pins 5 and 6 are the single step and interrupt pins, respectively. These pins are not used in this embodiment and are therefore connected to +5 volts. Capacitor 368 is a filter capacitor. Pin 7 is the internal/external select pin. With jumper 360 removed (as it is in the disclosed embodiment), program instructiions are read from a read-only memory ("ROM") which is internal to microcomputer 350. Pin 8 is the read control or RD pin which carries a signal for instructing other devices connected to the microcomputer that the microcomputer is ready to read data or other information from those other devices. Pin 9 is not used. Pin 10 is the write control or WR pin which carries a signal for instructing other devices connected to the microcomputer that the microcomputer is ready to write data or other information to those other devices. Pin 11 is not used. Pins 12–19 are the eight pins of an eight bit data bus, the individual leads of which are respectively designated DB0–DB7. Resistors 364 are pull-up resistors for the data bus leads. Pin 20 is the ground pin and is connected to ground as shown. Capacitor 366 is also connected between pins 4 and 20. Pins 21–24 and 35–38 are the eight pins of input/output port 2. The individual leads of input/output port 2 are respectively designated P20–P27. Pin 25 is a control line needed for communication between microcomputer 350 and input/output expanders 390 and 400 in the conventional manner. Pins 26 and 40 are power supply pins and are thus connected to +5 volts. Pins 27–34 in the eight pins of input/output port 1. The individual leads of input/output port 1 are designated P10–P17. Leads P10 and P11 are respectively connected to inverting buffers 200 and 190 in FIG. 2, and leads P12 and P13 are respectively connected to inverting buffers 300 and 290 in FIG. 3. Lead P14 is connected to tamper detector 370 which may be a conventional circuit for detecting when someone is trying to gain access to the interior of control unit 102. Lead P15 is connected to AC power detector 372 which may be a conventional circuit for detecting an AC power failure. Lead P16 is connected to cold water ground detector 374 which may be a conventional circuit for detecting that the connection to cold water ground has been disturbed. Lead P17 is connected to low battery detector 376 which may be a conventional circuit for detecting that the auxiliary battery power supply is low (e.g., after an extended AC power failure). Pin 39 is the toggle 1 or T1 pin which is connected to the output of comparator 262 in FIG. 4.

In addition to microcomputer 350, the data processing portion of control unit 102 includes programmable read-only memory or PROM 380, input/output expander 390, and input/output expander 400. PROM 380 is a conventional 256 by 4 bit PROM. PROM 380 is addressed by the signals applied to its address pins A0–A7. The four bits stored in the selected address location are applied to data pins Q1–Q4. Data pins Q1–Q4 are respectively connected to data bus leads DB0–DB3 of microcomputer 350. The signal applied to the S1 pin commands PROM 380 to supply the addressed data to data pins Q1–Q4 for reading by microcomputer 350. To conserve power, PROM 380 is only turned on when needed. This is controlled by the P70–P73 output signals of input/output expander 400 in conjunction with the circuit including resistors 382 and 384, transistor 386, and capacitor 388. The P70–P73 output signals of expander 400 are also applied to the S2 pin of PROM 380 as an enabling signal.

Each of input/output expanders 390 and 400 is a commercially available device (e.g., a model 8243 I/O expander available from Intel Corporatiion of Santa Clara, Calif.) for transmitting data between the four pins of input/output expander port 2 (i.e., pins 8–11) and a selected one of port 4 (i.e., pins 2–5), port 5 (i.e., pins 1 and 21–23), port 6 (i.e., pins 17–20), and port 7 (i.e., pins 13–16). Selection of the input/output expander to communicate with microcomputer 350 is controlled by the chip select or CS signal appearing at microcomputer 350 pins 35 and 36, respectively. These chip select signals are applied to CS pin 6 of the input/output expanders. The input/output expanders latch data applied to their ports 4–7 so that this data remains fixed until changed by new data. Power is applied to pin 24 of each input/output expander, and pin 12 of each input/output expander is connected to ground. A capacitor 392 is connected between pins 12 and 24 of each input/output expander. The details of communication between microcomputer 350 and the input/output expanders are conventional and are not important to the present invention.

Input/output expander 390 is used to control displays 112 and 114 and to accept data from keyboard 116. These elements of local control unit 102 are shown in detail in FIG. 5. As discussed in greater detail below, microcomputer 350 selects each bit P70–P73 of input/output expander 390 port 7 one at a time in a continuously repeating cycle. Each P70–P73 bit is selected for a predetermined relatively short interval of time (e.g., a small number of milliseconds) and is logical 0 while thus selected. Selection of the P70 bit turns on transistor 410 in cooperation with resistors 412 and 414. This applies power to the anodes of light emitting diodes DS1–DS7. At the same time that bit P70 is selected (logical 0), the appropriate ones of input/output expander 390 bits P50–P53 and P60–P62 are selected (logical 1) to cause current to flow through the desired ones of LEDs DS1–DS7. A respective one of inverters 421–427 and resistors 431–437 are connected in series between each LED DS1–DS7 cathode and bits P50–P53, P60–P62.

After P70 has been selected for a short time, it is unselected (thereby turning off LEDs DS1–DS7) and P71 is selected (logical 0) instead. Selection of P71 turns on transistor 440 in conjunction with resistors 442 and 444, thereby applying power to the anodes of LEDs DS8–DS13. While P71 is thus selected, the appropriate ones of P50–P53, P60, and P61 are selected to illuminate the desired ones of LEDs DS8–DS13 in a manner analogous to the illumination of LEDs DS1–DS7.

P71 is unselected after a short time (thereby turning off LEDs DS8–DS13), and P72 is selected. This turns on transistor 450 in conjunction with resistors 452 and 454 and thereby applies power to the anode of seven segment display device 114*b*. While P72 is thus selected, the appropriate ones of P50–P53 and P60–P62 are selected to illuminate the desired segments of display 114*b* to cause a desired decimal digit to appear.

After display 114*b* is energized for a short time as discussed above, display 114*a* is similarly energized by selection of P73 and appropriate ones of P50–P53 and P60–P62. Selection of P73 turns on transistor 460 in conjunction with resistors 462 and 464.

Commands and data entered by an operator via keyboard 116 are also read as a result of the cyclic selection of P70–P73. While P70 is selected, power is applied to one contact of all the normally open switches associated with the horizontal row of keyboard 116 buttons including the 0 button. If any button in that row is operated while P70 is thus selected, the associated one of P40–P43 is energized (logical 1). Otherwise P40–P43 remain at ground (logical 0) as a result of the operation of resistors 470–477. The four rows of keyboard buttons are energized one after another as a result of the cyclic selection of P70–P73. The identity of the button depressed at any given time is known from the concurrent row and column information represented by P70–P73 and P40–P43. The data latched into P40–P43 is transmitted to microcomputer 350 each time a different one of P70–P73 is selected.

Input/output expander 400 is used to address PROM 380 as discussed above and to control relay element 402, test element 404, and sounder 118. (Spare 406 is not used.). Relay element 402 is typically a conventional direct wire connection to a police or fire station. Test element 404 is part of low battery detector 376. When commanded by P41 of input/output expander 400, test element 404 effectively disconnects the system from AC power in order to test the auxiliary battery. If the battery is inadequate, low battery detector 376 will apply a low battery signal to microcomputer 350. Sounder 118 (FIG. 5) is energized when input/output expander 400 bit P43 is selected (logical 1). This logical 1 signal is inverted by inverter 408 so that current flows through sounder 118 from the positive voltage source.

The construction of a typical PID is shown within the broken line in FIG. 6. Although the PID shown in FIG. 6 is assumed to be one of alarm PIDs 16–63, the other possible types of PIDs include similar elements. The PID is connected to the C, S, G, and D lines of QUAD 108*a* or 108*b* as shown. The D line provides a source of +A volts for powering the PID and, when P latch 92 is set, the alarm sensor (not shown) connected to the PID. The G line provides a source of ground potential for the PID. The S line signal is applied to S line detector 70, which may be a conventional threshold detector circuit for detecting information pulses on the S line. S line detector 70 applies address and data pulses detected on the S line to address pulse counter 72 and data pulse counter 74, respectively. Pulse counters 72 and 74 may be conventional binary digital pulse counters which produce binary coded output signals representative of the number of pulses which have been applied to them. The address identifying the PID is stored in address storage register 78, which may comprise a plurality of on/off switches for collectively representing a binary number. The contents of counter 72 and register 78 are compared by comparator 76, which may be any conventional device for comparing two binary numbers and producing an output signal only when the two numbers being compared are equal. The output signal of comparator 76 is applied as an enabling signal to output gate logic 80 and steering logic 88. Thus devices 80 and 88 are enabled only when the number of address pulses received by the PID via the S line equals the address of the PID stored in register 78.

A data signal from the alarm sensor connected to the PID is applied to data detector 82. A typical alarm sensor data signal has three voltage levels (e.g., a high voltage if the sensor detects an alarm, a low voltage if the sensor is in a trouble condition, and an intermediate voltage if the sensor is operating properly and no alarm has been detected). Accordingly, data detector 82 may be a conventional threshold detector circuit for indentifying the information represented by the alarm sensor data signal and producing a plurality of output signals, each of which is representative of a respective one of the possible sensor conditions (e.g., alarm, trouble, normal). The output signals of data detector 82 are stored in data storage register 84, which may be a conventional binary storage register. If desired, data storage register 84 may be erased each time the output signal of comparator 76 switches to its disabling state to effectively reset the PID after each interrogation of the PID by local control unit 102. Data pulse counter 74 may also be reset at the same time if desired.

The output signals of data pulse counter 74 and data storage register 84 are applied to output gate logic 80. When gate logic 80 is enabled by comparator 76 as discussed above, it applies the information represented by a selected one of the output signals of data storage register 84 to line 81. The data storage register 84 output signal selected is determined by the contents of data pulse counter 74. For example, when data pulse counter 74 has counted one data pulse, the signal on the left-most output lead of data storage register 84 is applied to line 81; when data pulse counter 74 has counted two data pulses, the signal on the next left-most output lead of data storage register 84 is applied to line 81; and so on until as many data storage register 84 output signals as are desired have been applied in turn to line 81. The signal on line 82 is transmitted back to local control unit 102 via the S line. In this way local control unit 102 interrogates the PIDs and receives data from the PIDs via the S line.

As mentioned above, the K and P latches of the PIDs are controlled by pulses on the C line. The C line signal is applied to C line detector 86, which may be similar to S line detector 70. The output signals of C line detector 86, which respectively indicate latch set and latch reset commands, are applied to steering logic 88. Steering logic 88 also receives the output signals of data pulse counter 74 and, when enabled by the output signal of comparator 76 as discussed above, applies the output signals of C line detector 86 to either K latch 90 or P latch 92, depending on the concurrent contents of counter 74. Steering logic 88, like output gate logic 80, may be a conventional signal steering or switching device. K latch 90 and P latch 92 may be conventional bistable multivibrator or flip-flop devices. The output signals of the P and K latches may be used for any desired purposes, such as controlling an indicator light associated with the PID. In the particularly preferred embodiment shown in FIG. 6, the output signal of P latch 92 is applied to conventional gate 94 to control the flow of power from the D line to the alarm sensor associated with the PID. As discussed in detail above, this allows local control unit 102 to cut off power to certain alarm sensors when desired, such as during a prolonged AC power failure.

Figure 7:
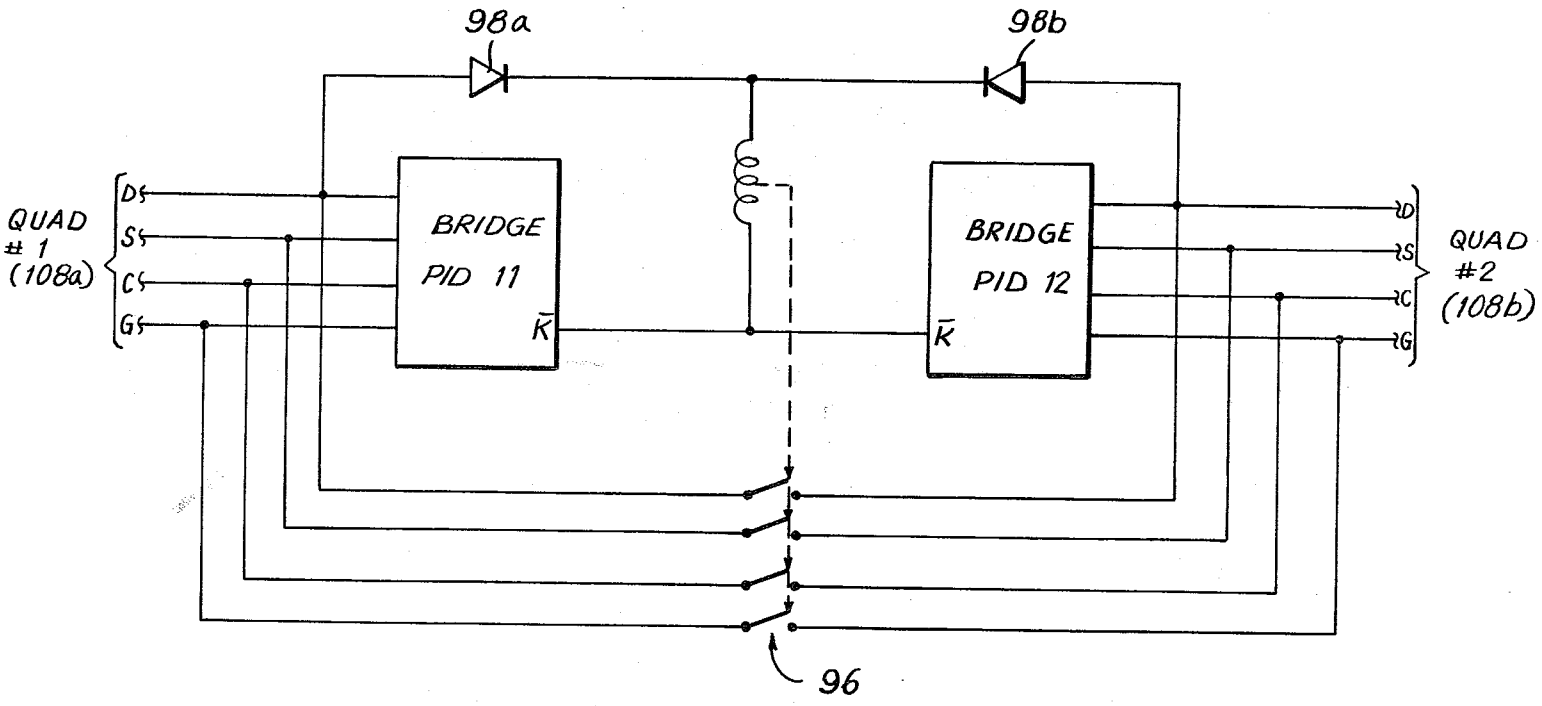
FIG. 7 is a block diagram of a typical installation of bridge PIDs in accordance with this invention.

As mentioned above (see discussion following Table A), bridge PIDs 11 and 12 can be used to selectively connect together the remote ends of QUAD cables **108*a* and 108*b* to form a closed loop. This is illustrated in FIG. 7 in which PID 11 is connected to the remote end of QUAD 108*a* and PID 12 is connected to the remote end of QUAD 108*b*. Each of PIDs 11 and 12 may be similar to the PID shown in FIG. 6. Preferably, PIDs 11 and 12 are both mounted in a single device. The four normally open contacts of four-pole relay 96 are respectively connected between the D, S, C, and G lines of QUADs 108*a* and 108*b*. The coil of relay 96 is connected between the K latch output of each bridge PID and the D line of the associated QUAD. (Diodes 98*a* and 98*b* isolate the D lines of the QUADs from one another while the contacts of the relay 96 are open.) The contacts of relay 96 can therefore be closed by setting the K latch of either PID 11 or 12. When the contacts of relay 96 are thus closed, the remote ends of the D, S, C, and G lines of QUAD 108*a* are connected to the remote ends of the D, S, C, and G lines of QUAD 108*b***.

If a break occurs in either QUAD **108*a* or 108*b* which prevents local control unit 102 from receiving data from some of the PIDs on that QUAD, local control unit 102 sends a command to the bridge PID 11 or 12 associated with the other unbroken QUAD to set the K latch of that bridge PID. This energizes relay 96, thereby connecting the remote ends of QUADs 108*a* and 108*b* together. Local control unit 102** can now communicate normally with PIDs beyond the break in the broken QUAD via the unbroken QUAD and the connection between the QUADs established by the bridge PIDs.

Use of the above-described bridge PIDs to circumvent a fault in either QUAD has several important benefits. First, it provides the protection of redundant connections between local control unit 102 and the PIDs without the need for expensive duplicate wiring. Second, no separate QUAD fault detection circuitry is required. The presence of a QUAD fault is known from the inability of local control unit 102 to receive data from one or more PIDs, and the fault is then promptly corrected by operation of one of the two bridge PIDs. Third, installations can be provided with or without this feature, as desired, simply by including or not including bridge PIDs 11 and 12. One common system design meets the need for both types of installations.

Communicator module 104 is not shown in detail because it may be conventional and because it does not form part of the present invention. In general, however, the function of communicator module 104 is to provide an interface between microcomputer 350 and the relatively long communications link to central station 106. When appropriately instructed by the WR, P26, and P27 signals, communicator module 104 converts data received from microcomputer 350 via data bus leads DB0–DB7 to a form suitable for transmission to central station 106 via whatever type of communications link is employed (e.g., radio, telephone, direct wire, etc.) Similarly, communicator module 104 converts data received from central station 106 to DB0–DB7 form and, when appropriately instructed by the RD, P26, and P27 signals, passes that data on to microcomputer 350 via DB0–DB7. Communicator module 104 may use a portion of the information stored in PROM 380, and for that purpose microcomputer 350 is programmed as described below to transmit PROM address information from communicator module 104 to input/output expander 400. Communicator module 104 also uses the reset signal from switch 356 so that both microcomputer 350 and the communicator module can be reset simultaneously.

An illustrative source program (with corresponding object program) for microcomputer 350 is provided in the microfiche appendix to this specification. The lines of the program listing are numbered consecutively from 1 to 5776 in the third column of the microfiche appendix. (A small prtion of the program (i.e., lines 897–1269 and 1387–1495) is not included in the microfiche appendix for reasons explained in detail below.) The object code information comprises the first two columns of information in the program listing. The object code information will not be specifically discussed herein because it is the exact equivalent of the source code which will be discussed. The source code information begins in the fourth column of the program listing. The forms of the source code statements used in the program are conventional and are explained in detail, for example, in the publication *MCS-48 Family of Single Chip Microcomputers; User's Manual,* Intel Corporation, Santa Clara, Calif., April 1979. Throughout the program listing, information to the right of a semicolon is comment information which forms no part of the program but which serves to explain the program.

Starting near the bottom of page 172 of the microfiche appendix listing and continuing through page 175 is an alphabetical tabulation of all the symbols defined in the program, with the hexadecimal (base 16) equivalent value of each symbol. Following page 175 are 17 pages on which all of the symbols defined in the program are listed again with the program line number of every reference to each symbol. A line number followed by the symbol "#" is the line number at which the symbol is defined. These two lists of variables and other symbols do not form part of the program, but are programming and diagnostic aids.

The first part of the program listing (i.e., lines 1–666) are statements which equate ("EQU") symbols used in the program to particular numbers. For example, line 6 states that the symbol PIDCNT, whenever encountered in the program, is to be interpreted as the decimal number 48. A number is a decimal number (base 10) unless followed by B or H. A number followed by B is a binary (base 2) number, and a number followed by H is a hexadecimal (base 16) number. Although the comments contained in the microfiche appendix listing are believed to be largely explanatory of lines 1–666, additional comments are provided here regarding selected lines:

Line 6: PIDCNT is equated to 48 because this is the maximum number of PIDs allowed in the system (exclusive to PIDs 0–15 which are each required to be of a particular type as set forth above).

Line 7: COMRAM is equated to 16 because communicator module 104 is allowed 16 bytes of data random access memory ("RAM") in microprocessor 350.

Line 8: MAXRAM is equated to 255 because the RAM required as part of microcomputer 350 has 256 bytes. A byte is eight bits and is the basic word length in microcomputer 350.

Line 11: PID0 is equated to 80 hexadecimal ("H") because the status byte for PID 0 is stored in data RAM location 80H. A status byte for each PID is stored in succeeding data RAM locations.

Line 13: EXMAP is equated to 0C0H because an existence map for the PIDs (i.e., a 1 or 0 to indicate the presence or absence of each of 64 possible PIDs) is stored in successive RAM memory locations beginning with location 0C0H.

Lines 20–25: The symbols specified here are respectively equated to registers ("R") 4–7. This means, for example, that wherever the symbol SYSTM1 appears, that symbol should be interpreted as register 4.

Lines 26–27: The symbol for the word "at" means "indirect". Thus the comment for line 26 should be read as "INDIRECT ADDRESS OF SYSTEM 1 REG".

Lines 30–160: These lines equate various symbols with data RAM locations. Thus line 32 equates the RAM address symbol KSB1 with data RAM location 20H, so that when KSB1 is used in the program as a RAM address, that symbol will be interpreted as data RAM location 20H. The capability of having two communicator modules is not used in the disclosed embodiment, so lines 126–143 can be ignored. Lines 150–157 are part of the definition of specialized PIDs 0–15 as discussed above.

Lines 164–205: These lines equate various symbols with locations in PROM 380. Thus line 166 equates the PROM address symbol FDIG1 with PROM 380 location 40H, so that when FDIG1 is used in the program as a PROM address, that symbol will be interpreted as PROM location 40H.

Lines 210–246: These lines equate various symbols to particular binary numbers which are used as masks to test or set particular bits in other data. The comments associated with each line indicate the significance of particular bits in the associated data. For example, line 212 is a mask for testing the so-called "external BA1-/internal" option bit stored in PROM 380. An explanation of the meaning and use of this particular option is given below in the discussion of lines 1997–2025.

Lines 250–286: These lines equate various symbols to code numbers (sometimes called passcode numbers) which are transmitted to the central station to report various conditions in the system.

Lines 294–401: These lines equate various symbols to particular binary numbers which are used as masks to test or set particular bits in other data. The comments associated with each line indicate the significance of particular bits in the associated data. For example, lines 294–299 define masks for use in testing P14–P17, respectively, of microcomputer 350. In particular, line 296 is used to test P14, and FIG. 4 shows that tamper detector 370 is connected to P14 as is consistent with the comment in line 296. In line 312 the comment "PORT 4-1" refers to port 4 of input/output expander 400. In lines 323 and 336 the comment "U3 8243" refers to input-/output expander 390.

Lines 404–407: These lines equate two symbols used to test two commands which can be sent from the central station to control part of the operation of local control unit 102.

Lines 411–434: These lines equate various symbols to particular values to control various aspects of the device such as the length of signal pulses on the S and C lines, the length of sounder 118 blasts, etc.

Lines 440–584: These lines equate various symbols to particular binary numbers which are used as masks to test or set particular bits in other data. The comments associated with each line indicate the significance of particular bits in the associated data in a manner similar to that discussed above in connection with lines 210–246 and 294–401.

Lines 588–662: These lines equate various symbols used in the so-called timer interrupt or front end program discussed in detail below.

The actual operating part of the source program begins at line 669. The program basically comprises a main program and a timer interrupt or front end program. The main program includes the following principal parts:

1. Start routine (chiefly lines 669–672, 1271–1362, 1543–1556): This routine is used only when the program is run for the first time or whenever reset button 356 (FIG. 4) is operated.

2. Input routine (chiefly lines 1560–1924): This routine sets up input data for processing by the process routine below. This routine accepts data from tamper detector 370, AC power detector 372, cold water ground detector 374, and low battery detector 376. This routine also sets up input data based on PID and keyboard data stored in the RAM.

3. Process routine (chiefly lines 1928–2363): This routine processes the information read in by the input routine and formulates appropriate responses to that information. For example, the process routine monitors expiration of the entry and exit time delays, it sets and resets data latches which indicate the occurrence of alarm conditions, and it controls and monitors the late close timer.

4. Output routine (chiefly lines 2367–3831): This routine sets up output data for use in controlling the various outputs of the system including LED display 112, seven segment display 114, sounder 118, the commandable output PIDs, the bell PID, the BA2 remote keyswitch module, relay device 402 (FIG. 4), and test device 404 (FIG. 4). The output routine also sets up output data for controlling the C line signals transmitted to the PIDs and the alarm and other information going to communicator module 104 for transmission to central station 106.

5. Miscellaneous (lines 1497–1539): These lines are merely a programming convenience to facilitate jumps between the two memory banks in the particular microcomputer 350 employed in the embodiment shown and described herein. No further detailed reference will be made to these lines.

The main program is interrupted at regular time intervals (typically every X milliseconds, where X is an arbitrary small number) to perform portions of the timer interrupt routine. The timer interrupt routine includes the following principal parts:

1. Initial portion of timer interrupt routine (lines 675–881): This portion of the timer interrupt routine controls clock data which in turn controls various timed functions throughout the program. This routine also reads keyboard data from input/output expander 390 (FIG. 4) and controls output devices 112, 114, 118, 402, and 404 via input/output expanders 390 and 400.

2. PID communication routine (not reproduced in the microfiche appendix for the reasons discussed in detail below): This portion of the timer interrupt routine controls actual physical communication with the PIDs via the S and C lines.

As mentioned above, the timer interrupt routine is called every X milliseconds. Program control remains in the timer interrupt routine less than X milliseconds. After processing of the front end program, microcomputer 350 reverts to working on the main program for the remainder of the X-millisecond time interval.

Although the comments contained in the microfiche appendix program listing are believed to be largely explanatory of the source program, additional comments are provided here regarding selected lines of the program.

Main Program—Start Routine

Lines 669–672, 1271–1274: These lines clear all locations of the data RAM to zero.

Lines 1278–1350: These lines read data from PROM 380 which indicates whether or not the associated installation includes a PID for each of the possible PID addresses.

Lines 1355–1359: These lines preset and start the timer interrupt counter. This counter is used to interrupt the main program every X milliseconds to initiate processing of the timer interrupt routine as described above.

Lines 1361 and 1370–1376 (line 1362 is discussed after line 1383 below): These lines initialize the program status word ("PSW") for the timer interrupt routine.

Lines 1378–1381: These lines initialize the PID address counter ("ADDCNT") with the number of PIDs in the installation. This is done so that microcomputer 350 will interrogate all the PIDs in the installation.

Line 1383: This line directs microcomputer 350 to perform a portion of the timer interrupt routine.

Lines 1362 and 1543–1556: These lines preset the AC timer, preset the start timer, turn on the BA1 system, preset the bell ring timer, and preset the bell ring counter. Elsewhere in the program, the AC timer is incremented (up to a predetermined amount such as four hours) each time a predetermined time interval passes with no loss of AC power, and decremented each time a predetermined time interval passes with no AC power. In this way, the AC timer represents the amount of time the system has been operating with AC power. The AC timer can therefore be used as an indication of the level of the charge on the backup battery. The start timer is used to prevent the system from responding to alarms during the first few seconds that the system is turned on. This allows the system to settle down before alarm indications are acted upon. The BA1 protection is turned on and the bell associated with the system rings whenever reset button 356 is operated and the start routine is therefore performed. In this way an alarm is produced in the event that the housing of local control unit 102 is ripped open and reset button 356 is operated.

Main Program—Input Routine

Lines 1560–1563: These lines store timing bits which are set up in the timer interrupt routine mentioned above. In this way the timer interrupt routine provides timing information which is used to control a variety of timed operations in the remainder of the program. The least significant bit of CLKTMP is set every N times the timer interrupt routine is called; the next least significant bit of CLKTMP is set every M times the least significant bit is set; the next least significant bit of CLKTMP is set every P times the preceding bit is set; and so on. In this way the various bits of CLKTMP (or CLOCK) have various time values and can be used to indicate that time intervals of various lengths have elapsed.

Lines 1567–1596: These lines control the keyboard enable timer register ("KBETR") so that the TEST, BYPASS, RESET, SILENCE, ON, and HOURS buttons on keyboard 116 (FIG. 5) will be enabled for a predetermined time interval after a valid passcode has been entered by an authorized operator of local control unit 102. In general, the digit buttons on keyboard 116 are always enabled, but the other keyboard buttons are only enabled after a valid passcode has been entered. At lines 1578–1579 a counter for controlling sounder 118 (also called "SONALERT" in the comments in the microfiche appendix) is preset when KBETR times out to cause a short audio tone from sounder 118 to indicate that the non-digit buttons of keyboard 116 have been disabled. At lines 1584–1594 a manager bit (indicating that the non-digit keyboard keys were enabled in response to one of four higher level passcodes), a hostage bit (indicating that the non-digit keyboard keys were enabled in response to a passcode accompanied by a hostage code), and display enable bits (used to enable some display test functions) are cleared.

Lines 1600–1612: These lines input and debounce the output signal of tamper detector 370 (connected to bit 4 ("B4") of port 1 ("P1") of microcomputer 350).

Lines 1616–1644: These lines input and debounce the output signal of low battery detector 376 (connected to bit 7 ("B7") of port 1 ("P1") of microcomputer 350). The fault 26 bit referred to at lines 1634–1635 is a bit which indicates detection of faults 2–6. As the comment at line 477 shows, these faults are low battery, cold water ground fault, PROM missing, bridge PIDs connected to one another (due to a break or fault somewhere along either QUAD 108*a* or QUAD 108*b*), and AC off for four hours. (See also the list of fault conditions in Table H below.) At line 1642 the person number subroutine ("PNSOX"), discussed below in relation to lines 5696–5732, is called to set up data which ultimately causes a passcode to be sent to communicator module 104 to indicate that a low battery has been detected.

Lines 1648–1698: These lines input and debounce the output signal of AC power detector 372 (connected to bit 5 ("B5") of port 1 ("P1") of microcomputer 350). These lines also control AC loss timer register ("ACLTR") to increment that register at predetermined time intervals (up to a maximum amount) while AC power is on, and to decrement that register at predetermined time intervals while AC power is off. ACLTR therefore provides a measure of how long the AC power has been off and consequently how much power remains in the backup battery. ACLTR is used elsewhere in the program to turn off power to the alarm sensors or other devices associated with certain PIDs (e.g., burglar alarm sensors) after a prolonged AC power failure in order to conserve remaining battery power for continued operation of other more important devices (e.g., fire alarm sensors). This is done by turning off the P latch in the PIDs associated with the sensors to be turned off (see discussion of the P and K latches mentioned above in relation to the C line signals).

Lines 1702–1729: These lines input and debounce the output signal of cold water ground detector 374 (connected to bit 6 ("B6") of port 1 ("P1") of microcomputer 350).

Lines 1733–1745: These lines make certain that a PROM 380 is plugged into the circuitry of local control unit 102.

Lines 1750–1762: These lines test the status of the bridge PIDs to determine whether they are connected to one another due to a break or fault in either QUAD 108*a* or 108*b*.

Lines 1767–1775: These lines check the proper functioning of communicator module 104 in order to set up data to illuminate LED DS3 (the telecommunications failure indicator) of LED display 112 if communicator module 104 indicates a problem.

Lines 1780–1880: These lines process data received from the remote BA2 keyswitch module (i.e., PID 14) and stored in the data RAM to turn on or off the BA2 system as requested by the PID 14 data (if the system is in a condition in which the request can be honored) and to generate the passcode number of the BA2 keyswitch module operator who requested that the BA2 protection be turned on or off. As mentioned above in the discussion following Table A, the BA2 keyswitch module (not shown in detail herein because it forms no part of the present invention) is a PID-type device including a keyboard and microprocessor and which is typically located near the area protected by the BA2 system (e.g., a vault or storeroom inside the premises protected by the BA1 system). An operator wishing to turn the BA2 protection on or off enters his passcode via the BA2 keyswitch module keyboard. The BA2 keyswitch module validates the passcode and sets up the first four bits of the data to be transmitted back to local control unit 102 via the S line to represent (first bit) the fact that a change of state of the BA2 system has been requested and (next three bits) a code number for the person who requested the change of state. A request from the BA2 keyswitch module is merely a request to change the state of the BA2 system from whatever its present condition to the other condition. Local control unit 102 honors the BA2 keyswitch request and changes the state of the BA2 system only if the condition of the system (as monitored by local control unit 102) permits the BA2 system to change state. At lines 1782–1789 the data received from PID 14 is read from the data RAM and tested to determine whether a request for a change of state has been made. At line 1811 the program determines whether the BA2 system is now on or off. Lines 1815–1822 are performed if the BA2 system is now off and the BA2 keyswitch request is therefore to be interpreted as a request to turn on the BA2 system. The BAXON subroutine at lines 4760–4845 determines whether the system is in condition to have the BA2 system turned on, and if so, turns on that system by turning on the BA2 ON bit in system status word SYSTM2. Lines 1827–1877 are performed if the BA2 system is now on and the BA2 keyswitch request is therefore to be interpreted as a request to turn off the BA2 system. The reference to "nested" in the comments associated with these lines is explained below in the discussion of lines 4144–4209. At lines 1835–1837 the BA2 system is turned off by turning off the BA2 ON bit in system status word SYSTM2. At lines 1839–1843 the BA2 late close timer is preset. At lines 1845–1866 any BA2 PIDs which have been bypassed (i.e., effectively removed from the system) are put back in the system to prevent any BA2 PID from being permanently bypassed. And at lines 1869–1877 data is set up to send to central station 106 the passcode of the person turning off the BA2 system, unless the system has only "Sans" service (i.e., the class of service in which only alarms and not openings and closings are reported to the central station).

Lines 1884–1889: These lines call two major subroutines known as the point in and key in subroutines. The point in subroutine (lines 4851–5497) sets up some summary data based on the data from the PIDs which is stored in the data RAM. The key in subroutine (lines 3949–4578) responds to keyboard 116 of local control unit 102. These subroutines are discussed below following the discussion of the small remaining portion of the main program input routine.

Lines 1892–1924: These lines input commands transmitted from central station 106 to local control unit 102 via communicator module 104. Although other central station commands are possible, the particular embodiment disclosed herein includes only the capability of receiving central station commands to turn on the BA1 and BA2 systems. Communicator module 104 writes to a data RAM location called CMDB11. At lines 1894–1900 the program reads CMDB11, and at lines 1902–1909 the program decodes this data to determine whether the central station command is to turn on BA1 or BA2. At lines 1912–1914 the BAXON subroutine (discussed above) is called to turn on the appropriate BA system, if the condition of the system permits. At lines 1916–1922 the appropriate BA1 and BA2 exit bits are set. These bits are used in the exit timer routine discussed below as part of the main program process routine.

Main Program—Point In Subroutine

As mentioned above, the point in subroutine (lines 4851–5497) reads the PID data stored in the data RAM and sets up some summary data regarding the status of the PIDs in the system. This summary data is later processed in the main program process routine.

Lines 4853–4855: These lines cause the program to skip the remainder of the point in subroutine until the start timer has timed out (see the discussion of the main program start routine above). The start timer allows the system to settle down after it is first turned on or after reset switch 356 is operated.

Lines 4857–4864: These lines check the status of the reset timer which is preset whenever the RESET button on keyboard 116 is validly operated.

Lines 4867–4874: These lines are performed only when the reset timer just becomes equal to zero. The fire alarm latch and the status bits ("STAT1") are cleared. Lines 495–502 explain the significance of the STAT1 bits. For example, the least significant bit of STAT1 indicates that an alarm condition has been detected by a BA1 fixed PID.

Lines 4877–4885: These lines are performed only when the reset timer has not yet timed out. These lines clear all of the alarm memories which are used elsewhere in the program for such purposes as controlling the local control unit displays.

Lines 4887–4895: These lines clear or do not clear status bits (STAT1 and STAT2) as is appropriate depending on the preceding program steps.

Lines 4897–4899: These lines clear all bypass flags (i.e., the flags which indicate whether any PID in each of the BA1, BA2, fire alarm ("FA"), or supervisory ("SUP") groups is bypassed).

Lines 4901–4919: These lines set up two summary-type bits which respectively indicate whether or not any BA1 or BA2 points are bypassed.

Line 4921: This line presets a pointer register ("R0") to the data RAM address of the first PID (which can transmit data to local control unit 102 (i.e., PID 11). PIDs 0–10 are commandable output PIDs which can only receive data from the local control unit (see Table A above).

Line 4923: This is the start of a loop (which ends at line 5494) which is used to input and process the data RAM information for each PID in turn. Lines 528–535 indicate the significance of each bit in the data RAM location for each PID.

Lines 4923–4938: These lines determine whether the PID data reflects any "off-normal" condition (i.e., an alarm, trouble, tamper, bypass, or PID communication trouble condition). If no "off-normal" condition is indicated, the program jumps to line 5454.

Lines 4942–4959: These lines are performed only if PID communication trouble is indicated (i.e., if local control unit 102 is unable to communicate with the PID). These lines set the relay bits for PIDs 11 and 12 (i.e., the special bridge PIDs) if the communication trouble is with either of these PIDs. Setting the relay bits for these PIDs ultimately causes these PIDs to interconnect the remote ends of QUADs **108*a* and 108*b* so that communication can be resumed with all PIDs in the event of a break in either QUAD. These lines also set a quad trouble passcode for transmission to central station 106 to indicate a problem in QUADs 108*a* and/or 108*b***.

Lines 4961–4963: These lines cause the program to jump to line 4972 if the PID is one of special PIDs 11–15.

Lines 4967–4969: These lines set a PID trouble passcode for transmission to central station 106 to indicate that a PID communications problem has been detected.

Lines 4972 et seq.: These lines deal with all "off-normal" PID conditions.

Line 4972: This line clears a flag ("F0") which is used to signal that a PID is a BA2 PID.

Lines 4974–4980: These lines cause the program to jump to line 5276 if the PID is one of special PIDs 11–15.

Lines 4982–4993: These lines read from PROM 380 data indicating the type of PID being processed.

Lines 4997–5012: These lines define the PROM data for the various types of PIDs. DB is an instruction meaning "define byte". The comment "VEL" stands for "redundant" as in Table B above.

Lines 5014–5019: These lines cause the program to jump to specific routines for handling the various BA PID types.

Lines 5020–5036: These lines cause the program to jump to specific routines for handling the various BA PID types after setting flag F0 to indicate that the PID is a BA2 PID.

Lines 5038–5042: These lines cause the program to jump to specific routines for handling the various non-BA PID types.

Lines 5047–5049: These lines handle the unreal condition that an "off-normal" condition has been found in a PID which PROM 380 cannot identify (e.g., because PROM 380 has been removed). The program jumps to line 5276 to set up a system trouble passcode for transmission to central station 106.

Lines 5053–5144, 5408–5497, and 5570–5588: These lines process the PID data for BA fixed alarm protection points. BA fixed protection points (e.g., window foil, glass breakage sensors, and the like) are active at all times. While the associated BA protection is on, an alarm, trouble, tamper, or communication failure from a fixed protection point is recognized as an alarm. While the association BA protection is off, an alarm from a fixed protection point is recognized as a "day trouble". At lines 5050–5058 a test is made to determine whether or not the point is bypassed. If the point is bypassed, lines 5060–5066 increment the appropriate count of bypassed points and cause the program to jump to a line near the end of the point in subroutine. If the point is not bypassed, the program continues at lines 5072–5076 where some bookkeeping is done to take care of redundant protection points (i.e., points which require alarm confirmation from another protection point before an alarm will be sent). This includes calling the redundant set subroutine (lines 5570–5580) to set a redundant bit if the point is a point requiring alarm confirmation from another point. At lines 5078–5084 some tests are performed to validate an alarm indication. At lines 5086–5089 a fixed status bit is set to indicate that a fixed BA protection point has signalled an alarm. The appropriate status bit is actually set by calling the STASET subroutine at lines 5584–5588. At lines 5094–5097 various program branches are taken depending on whether the BA protection is on or off and depending on whether the protection point is part of the BA1 or BA2 system. If the BA protection is off, lines 5099–5105 are performed to place the PID or zone number in a fixed alarm memory which is used later to control display of alarm or trouble conditions. The program then jumps to lines 5408–5447 where a check is made to determine whether the PID is one of six special PIDs for which specific identifying codes are transmitted to central station 106. If the PID is one of the six special PIDs, the appropriate passcode is set up. In any event, a relay bit is set for later use in transmitting a relay signal to the K latch of the PID via the C line to turn on a light at the PID to facilitate identification of that PID as one which has detected an alarm. Then the program jumps to lines 5485–5494 to repeat the point in subroutine loop for the next PID. If at line 5097 (discussed above) the BA protection was found to be on, the program jumps to lines 5108–5144 where the bell ring timer is preset (to subsequently cause the program to ring the alarm bell) and to place the PID or zone number in the alarm memory buffer (used subsequently to control the display of alarm conditions). This latter function is performed by calling the alarm memory subroutine (line 5502–5565) discussed below. The program then jumps to lines 5408–5447 and 5485–5494 as discussed above.

Lines 5150–5186: These lines process the PID data for BA movable instant alarm protection points. As mentioned above, these are protection points typically associated with doors for which no alarm indication is produced if the door is opened while the BA protection is off, but for which an instantaneous alarm is produced while the BA protection is on. At lines 5152–5153 part of the BA fixed routine discussed above is used to process the BA movable instant data if the PID is bypassed. Similarly, at lines 5155–5164 parts of the BA fixed routine are used to process the BA movable instant data if the PID is signalling trouble, tamper, or communications failure. At lines 5166–5170 some bookkeeping is done (as in the BA fixed routine) to account for redundant points. At lines 5173–5183 the movable status bit is set and (if the exit time delay is zero) part of the BA fixed routine (lines 5108–5144, etc.) is used to process the alarm like a fixed protection point. If the alarm is not validated at line 5176–5180, the program jumps to line 5408, and continues as discussed above in connection with the BA fixed protection points.

Lines 5191–5229: These lines process the PID data for BA movable delayed alarm protection points. As mentioned above, these are protection points typically associated with doors which are used for entry in order to turn the BA protection off or for exit after the BA protection has been turned on. Thus alarm indications from these PIDs are not recognized as alarms until after expiration of entry or exit time delays. Lines 5193–5214 are logically similar to lines 5152–5174 of the BA movable instant routine above. At lines 5216–5229 the processing is similar to the BA fixed alarm processing if the exit time delay is not zero (meaning that the PID has detected an open door either while the BA protection is off or before expiration of the exit time delay). If the exit time delay is zero, however, further processing continues in the alarm memory subroutine (lines 5502–5565) discussed below. After the alarm memory subroutine has been called, parts of the BA fixed routine discussed above are used for further processing of the BA movable delayed data.

Lines 5502–5565: These lines are the alarm memory subroutine. In general, this subroutine saves the number of the first PID to indicate a trouble or alarm, together with a code number representing the type of trouble or alarm detected. This information is used subsequently to control a display so that the subscriber and/or service personnel will know what initiated an alarm or trouble. There are seven memories controlled by this subroutine as follows (see also lines 88–94):

TABLE D

| Memory Name | Memory |
|---|---|
| FAMR | The first fire alarm. |
| FXAMR | The first of the following conditions while the BA1 protection is off:<br>1. A BA1 fixed alarm, trouble, tamper, or communications failure.<br>2. A trouble, tamper, or communications failure in a BA1 movable instant, BA1 movable delayed, or BA1 holdup protection point. |
| FXAMR2 | Same as FXAMR but for BA2 system. |
| SPAMR | The first supervisory alarm. |
| TBLMR | The first trouble, tamper, or communications failure in a fire alarm or supervisory alarm PID. |
| SAMR | While the BA1 protection is on, the first BA1 fixed alarm, the first BA1 movable instant alarm, or (after expiration of the entry time delay) the first BA1 movable delayed alarm. |
| SAMR2 | Same as SAMR for BA2 system. |

The alarm memory subroutine does not directly control SAMR and SAMR2. Rather, this subroutine controls temporary buffers AMBR and AMBR2, the contents of which are respectvely transferred to SAMR and SAMR2 when the entry time delay expires. At lines 5502–5520 the PID number is encoded as the first six bits of a data byte. At lines 5524–5552 the appropriate code number for alarm, trouble, tamper, or communications failure is added to the data byte. At lines 5556–5565 the data byte is stored in the appropriate alarm memory.

Lines 5233–5236: These lines process the PID data for BA fixed redundant protection points. The processing is the same as for BA fixed points except that the redundant subroutine (lines 3913–3944) discussed below is called before the normal BA fixed processing begins.

Lines 3913–3944: These lines are the redundant subroutine mentioned above. Redundancy only requires confirmation of an alarm or trouble indication. It has no effect on the processing of tamper or communications failure indications. A redundant alarm receives a full response (e.g., the local bell rings), but a different (low level) alarm signal is sent to central station 106 unless or until the redundant alarm is confirmed by another alarm. The requirement for confirmation of a redundant alarm or trouble indication is overridden when any point in the system is bypassed. At lines 3917–3924 the program returns to the calling routine if the PID data is indicating only tamper or communications failure or if any point in the system is bypassed. The calling routine will then continue processing as though the point were not a redundant point. At lines 3926–3939 the program checks to see if any other alarm has been indicated. If another alarm has not been indicated, at lines 3941–3944 the program returns to the calling routine with the carry flag set to indicate that the point is a redundant point requiring confirmation. If another alarm has been indicated, the program returns to the calling routine without setting the carry flag.

Lines 5241–5245: These lines process the PID data for BA movable instant redundant points. The logic is similar to that for BA fixed redundant points discussed above.

Lines 5250–5254: These lines process the PID data for BA movable delayed redundant points. The logic is similar to that for BA fixed redundant points discussed above.

Lines 5258–5329: These lines process the PID data for supervisory alarm PIDs. At lines 5260–5268, if the reset timer (controlled by the RESET button on keyboard 116) is not zero or if the point is bypassed, the processing of the PID data is terminated and the program jumps to steps which have already been discussed. At line 5271 the program jumps to line 5315 if a supervisory alarm has been indicated. At lines 5274–5285 tests are made to determine whether communications failure is indicated, and if not, whether the PID is PID 14 (i.e., the BA2 keyswitch module). This is done because the alarm, trouble, and tamper bits for the BA2 keyswitch module are used to encode a person number code and therefore must not be interpreted here as indicating an alarm, trouble, or tamper. If the PID is not PID 14 and the off-normal condition indicated is tamper only, lines 5287–5290 cause the program to jump to a portion of the BA fixed routine discussed above. At lines 5292–5301 the trouble status bit is set if there is an alarm, trouble, or communications failure and the PID number is stored in the trouble memory (TBLMR) (see the discussion of the alarm memory subroutine above). At lines 5303–5304 and 5310–5311 the program jumps to a portion of the BA fixed routine discussed above if there is also a tamper indication. If there is no tamper indication, the program jumps at line 5308 to line 5408, etc., which is discussed above in the discussion of the BA fixed routine. At line 5314 processing continues from a jump at line 5271, discussed above. Lines 5314–5321 set the supervisory alarm status bit and place the PID number and alarm code number in the supervisory alarm memory (SPAMR) mentioned above in the alarm memory subroutine. Lines 5324–5329 resume processing from the jump at line 5268 and set the supervisory bypass bit.

Lines 5334–5379: These lines process PID data for fire alarm points. Lines 5336–5347 are similar to the reset timer and bypass tests performed at the start of other PID data processing routines. At lines 5349–5351 the program jumps to part of the supervisory alarm routine discussed above if the PID is indicating a off-normal condition other than an alarm. If the PID is indicating an alarm, lines 5354–5360 set the fire alarm status bit and prepare to call the alarm memory subroutine. Lines 5362–5376 provide a re-sounding feature. When a fire alarm is first received a fire alarm bell begins to ring. This alarm can be acknowledged and the bell silenced by operating the SILENCE key on keyboard 116. The alarm remains stored in the fire alarm memory register (FAMR) for later investigation. If another fire alarm indication comes in from a different PID while the bell is silenced, the fire alarm bell will ring again and the new PID number will be stored in FAMR in place of the old number. At line 5379 the program jumps to call the alarm memory subroutine discussed above.

Lines 5386–5404: These lines process PID data from holdup alarm points. Lines 5389–5390 perform the usual bypass test. Lines 5392–5393 and 5398–5404 respond to a holdup alarm in a manner similar to the response for other alarms. At line 5396 the program jumps to part of the fixed alarm routine discussed above if the PID data indicated an off-normal condition other than an alarm.

Main Program—Key In Subroutine

As mentioned above, the key in subroutine (lines 3949–4578) responds to data from keyboard 116 on local control unit 102. The key in subroutine is called by the main program input routine after the point in subroutine steps have been performed for all of the PIDs in the system.

Lines 3949–3954: These lines test the register KEYBUF to determine whether or not there is any new key information in that register. The KEYBUF register is actually loaded with key information during the timer interrupt routine discussed below. If there is no new key information, the program returns to the calling main program input routine. Otherwise the new key information is processed in this subroutine as described below.

Lines 3957–3962 and 3995–4010: These lines convert the key identification stored in KEYBUF to a code which identifies the key that has been operated for the remainder of the key in subroutine as follows:

TABLE E

| Actual Keyboard 116 Key | KEYBUF Key No. | Key In Subroutine Code No. |
|---|---|---|
| SILENCE | 0 | F |
| ON | 1 | A |
| 0 | 2 | 0 |
| HOURS | 3 | B |
| RESET | 4 | E |
| 9 | 5 | 9 |
| 8 | 6 | 8 |
| 7 | 7 | 7 |
| BYPASS | 8 | C |
| 6 | 9 | 6 |
| 5 | A | 5 |
| 4 | B | 4 |
| TEST | C | D |
| 3 | D | 3 |
| 2 | E | 2 |
| 1 | F | 1 |

As can be seen from the foregoing table, the key in subroutine code numbers for the ten digit keys (0–9) correspond to digits represented by those keys, while the command keys (SILENCE, ON, HOURS, RESET, BYPASS, and TEST) have key in subroutine codes which are the hexadecimal digits A–F. It should be noted that after some initial processing, the key in subroutine converts the code for the zero button from 0 to hexadecimal A so that the code for the digit 0 is not confused with an empty storage location.

Line 3963: This line stores the KEYBUF information in a temporary register.

Lines 3964–3992: These lines cause the program to jump to one of seven routines for handling specific types of keyboard data as follows:

TABLE F

| Keyboard Data | Routine |
|---|---|
| Digits 0–9 | Combo routine (lines 4014–4137) |
| ON | ON button routine (lines 4141–4209) |
| HOURS | HOURS button routine (lines 4213–4264) |
| BYPASS | BYPASS button routine (lines 4268–4420) |
| TEST | TEST button routine (lines 4424–4473) |
| RESET | RESET button routine (lines 4479–4551) |
| SILENCE | SILENCE button routine (lines 4557–4578) |

Lines 4014–4137: These lines are the so-called combo routine for handling keyboard digit data. At lines 4017–4019 a test is made to insure that no more than 15 buttons have been pressed in a predetermined relatively short time interval. This is done to reduce the possibility that someone will chance upon a valid passcode by attempting to rapidly test a large number of digit combinations. If more than 15 buttons have been pressed in the specified time interval, the program jumps back to the main program input routine without processing the excess keyboard data. At lines 4021–4028 the preceding test is effectively discontinued after a valid passcode has been entered and while the keyboard is "enabled" in response to that valid passcode so that any number of digits can be entered. At lines 4031–4047 the digits received are entered into a pushup stack (with the code number for zero converted from 0 to A, as mentioned above, to prevent a stack location representing zero from being erroneously interpreted as empty). At lines 4049–4117 the data in the stack is compared with a plurality of valid passcodes which are stored in PROM 380. There are five groups of valid passcodes stored in PROM 380 as follows:

TABLE G

| Group No. | Number of Passcodes in Group | Type of Passcodes in Group |
|---|---|---|
| 1 | 3 | Service personnel passcodes |
| 2 | 4 | "Manager" (i.e., higher level subscriber) passcodes |
| 3 | 4 | Ordinary (i.e., lower level subscriber) passcodes |
| 4 | 4 | Ordinary (i.e., lower level subscriber) passcodes |
| 5 | 4 | Ordinary (i.e., lower level subscriber) passcodes |

A code compare subroutine ("CCSO", lines 4581–4747) is called to compare the data in the stack to each group of passcodes until a match is found or until all passcode groups have been checked without finding a match. (In each group it is assumed that the first digit is the same.) If a match is found among the service personnel passcodes, a service bit is set (lines 4065–4071) and data is set up to send a "service person on premises" passcode to central station 106 (lines 4074–4076). If a match is found among the manager passcodes, a manager bit is set at lines 4089–4091.

If no match is found among any of the passcode groups, lines 4114–4115 set up data to subsequently cause sounder 118 to produce a short beep to acknowledge that the digit key data has been accepted, and the program jumps back to the main program. If a match is found among any of the passcode groups, lines 4119–4137 are performed to test for the presence in the keyboard data stack of an additional digit entered with a passcode to enable the subscriber to signal that he is being held hostage. If hostage data is found, a hostage status bit is set. In either case, at line 4135 the program jumps to logic (discussed below) for presetting the keyboard enable timer (so that the command keys like ON, SILENCE, etc., can be operated for a predetermined limited time interval), for setting up data to produce a long sounder 118 beep (to acknowledge entry of a valid passcode and enabling of the keyboard command keys), and for clearing the keyboard data stack.

Lines 4581–4747: These lines are the code compare subroutine mentioned in the preceding paragraph. At lines 4585–4640 the data in the keyboard data stack is compared with a specific group of valid passcodes and control is returned to the calling routine with flag zero ("F0") equal to zero if the stack data does not match any valid passcode in the group being tested. Lines 4643 et seq. are performed if the stack data does match a valid passcode in the group being tested. At lines 4644–4650 the code number of the person whose passcode has been validated is saved. At lines 4653–4655 the program jumps to line 4741 if the BA1 protection is already off. At lines 4658–4661 the BA1 protection is turned off. At lines 4663–4667 the BA1 late close timer is preset to whatever value is stored in PROM 380. At lines 4669–4670 an auto-test timer is preset. This is subsequently used to test the backup battery and to ring the alarm bell for a few seconds. If the class of service is other than "Sans", at lines 4672–4678 the code number of the person whose passcode has been validated is processed for subsequent transmission to the central station. At lines 4681–4711, if the BA2 protection is on, the BA2 protection is turned off if either a service passcode was entered or the system has the so-called link option which requires the BA2 protection to go off when the BA1 protection is turned off. Also, if the class of service is not "Sans", the code number of the person whose passcode has been validated is processed for subsequent transmission to the central station to identify the person who turned off the BA2 protection. At lines 4713–4739 all previously bypassed points are cleared. This prevents any points from being permanently bypassed. At line 4741 flag zero ("F0") is set to indicate that a passcode has been validated. Lines 4744–4747 reset communicator module 104.

Lines 4141–4209: These lines respond to operation of the ON button on keyboard 116. Lines 4144–4145 cause the program to return from the key in subroutine with the keyboard data stack cleared if the ON button is operated while keyboard 116 is not enabled (i.e., prior to entry of a vaalid passcode). Lines 4147–4150 clear a test mode latch which is discussed below in connection with the TEST key. Lines 4153–4162 allow the BA protection to be turned on in response to operation of the ON button only if no PIDs are bypassed. By means of an option stored in PROM 380, the program may allow the BA system to be turned on if there is one point bypassed, but this is only permitted if the display is enabled so that the subscriber will be alerted to the fact that a point is bypassed. Lines 4164–4172 determne whether the system is in the service mode or if the BA1 and BA2 systems are nested or linked. The nested option (stored in PROM 380) requires that the BA2 protection be on before the BA1 protection can be turned on. If the nested option is selected, a valid request to turn on BA1 automatically turns on BA2. The linked option (stored in PROM 380) requires that the BA2 protection turn on and off with BA1. Since there is no provision for entering a service passcode via the BA2 keyswitch module, BA1 and BA2 are temporarily linked while the system is in the service mode. Lines 4174–4184 are performed if the system is nested, linked, or in the service mode. At lines 4174–4178 the BA1 system is tested to make certain that it can turn on because BA2 should not be turned on if BA1 cannot also be turned on. The test as to whether a BA system can turn on is performed by the BAXON subroutine (lines 4751–4845) discussed below. Lines 4180–4184 are performed if BA1 can be turned on. These lines therefore turn on BA2 if possible. Lines 4186 et seq. are performed if BA2 is turned on or if the system is not nested or linked. At lines 4187–4192 BA1 is turned on if possible. Lines 4195 et seq. are performed if BA1 is turned on. Lines 4195–4196 clear the keyboard enable timer, thereby making operation of the ON button the last keyboard operation that can be performed. At lines 4198–4200 the program jumps to a portion of the bypass subroutine discussed below to preset sounder 118 for a long beep (to acknowledge that the BA system has been turned on), to clear the keyboard data stack, and to conclude processing of the key in subroutine. Lines 4202–4209 are performed if any point is in an off-normal condition (including bypass). These lines set the display enable bit to force display of the off-normal condition. These lines also dishonor the request to turn on the BA system.

Lines 4751–4845: These lines are the BAXON subroutine mentioned in the preceding paragraph. The BAXON subroutine checks for all types of fault or off-normal conditions which should prevent either BA1 or BA2 from turning on. These conditions are as follows:

TABLE H

| | Fault or Off-Normal Condition | Tested at Lines |
|---|---|---|
| 1. | Communication line trouble or fault (FALT 1). This means that communicator module 104 is signalling some communication trouble with central station 106. | 4760–4763 |
| 2. | Low battery (one contributor to FALT 26). | 4760–4763 |
| 3. | Cold water ground fault (another contributor to FALT 26). | 4760–4763 |
| 4. | PROM 380 missing or defective (another contributor to FALT 26). | 4760–4763 |
| 5. | Bridge PID (i.e., PID 11 or 12) closed (another contributor to FALT 26). | 4760–4763 |
| 6. | AC power off for extended time (another contributor to FALT 26). | 4760–4763 |
| 7. | AC power off (FALT 7). | 4760–4763 |
| 8. | Communication trouble detected by control unit 102 in communicator module 104 (FALT 8). | 4760–4763 |
| 9. | The BA loop being tested is open (e.g., any BA point in the loop being tested is signalling an alarm condition). | 4765–4772 |

TABLE H-continued

| | Fault or Off-Normal Condition | Tested at Lines |
|---|---|---|
| 10. | No bypass option selected in PROM 380 and any point is bypassed. | 4774–4787 |
| 11. | More than one point is bypassed (regardless of bypass option selected in PROM 380). | 4774–4787 |

If any of these tests is positive, the BA system being tested cannot be turned on and the program jumps back to the calling routine with the carry bit cleared to indicate that fact. At lines 4790–4795 (which are reached only if none of the foregoing tests indicate that the BA1 or BA2 system cannot be turned on) the program jumps back to the calling routine if the BAXON subroutine was called only to determine whether or not the BA1 or BA2 system could be turned on. Otherwise the BAXON subroutine continues at lines 4797–4801 where a test is made to determine whether the BA system being tested is already on. At lines 4803–4805 the BA system (which is presently off) is turned on. Lines 4807–4809 set a ring back request bit which subsequently causes sounder 118 to produce an audio indication that the fact that the BA system has been turned on has been communicated to central station 106. (This audio indication is not provided if the system has only Sans service.) At lines 4811–4815 the fixed alarm memories are cleared, and at lines 4817–4820 the security alarm memories are cleared. If the service is not Sans (which is tested at lines 4822–4828), data is set up at lines 4830–4832 to send to central station 106 the passcode of the person turning on the BA system. And if there are any points bypassed (which is determined at lines 4834–4835), data is set up at lines 4837–4841 to send to central station 106 the bypass passcode. At lines 4843–4845 the program returns to the calling routine with the carry bit set to indicate that the BA1 system has been turned on Lines 4213–4264 and 5593–5675: These lines process commands entered via the HOURS button on keyboard 116. The function of the HOURS button is to allow the subscriber to extend his normal closing time. After a valid passcode has been entered, the subscriber presses the digit button or buttons on keyboard 116 representing the number of hours from the present to the new anticipated closing time. Then the subscriber presses the HOURS button. If the request is valid, it establishes a new anticipated closing time. At lines 4217–4218 a check is made to make sure that keyboard 116 is enabled. At lines 4220–4224 a test is made to determine whether or not the extended closing function is precluded by an option stored in PROM 380. For example, if the system only has Sans service, it does not monitor when the system is turned on or off, so the extended closing feature is not needed. At lines 4226–4229 an hours display bit is set for use in subsequently controlling the hours display. At lines 4231–4233 the last two digits in the keyboard data stack are converted to a binary number. This includes (1) calling the zero convert subroutine (lines 5593–5624) to convert any hexadecimal A in the keyboard data stack to zero because, as noted above, the combo routine converts any zero to an A, and (2) calling the BCD to binary subroutine (lines 5629–5675) to perform the actual BCD (binary-coded-decimal) to binary conversion. Lines 4236–4237 cause the program to jump to line 4262 if the resulting binary number is 0. Lines 4239–4242 invalidate any number of hours greater than 36. At lines 4244–4249 the number of hours entered is multiplied by a scale factor and the result is entered in the late close timer. Lines 4251–4252 set up data for subsequently informing central station 106 that the closing time has been changed. Lines 4255–4257 set up data for subsequently informing central station 106 who changed the closing time. At line 4259 the program jumps to part of the bypass routine to reenable the keyboard, to set up data for producing a long sounder 118 beep (to acknowledge that the hours request has been honored), to clear the keyboard data stack, and to return to the main program. At lines 4262–4264, if zeros or no data were entered prior to operation of the HOURS button, data is set up so that the present contents of the late close timer will be displayed to inform the subscriber of the amount of time remaining in that timer. The sounder ("SONALERT") timer is used to time the duration of the hours display.

Lines 4268–4420 and 5680–5692: These lines process commands controlled by the BYPASS button on keyboard 116. There are three types of bypass functions controlled by the following sequences of keyboard 116 button operations:

TABLE I

| Keyboard Button Sequence | Bypass Function |
|---|---|
| # BYPASS (where # represents the one or two digit number of a PID to be bypassed) | Bypass PID unless already bypassed. If already bypassed, remove bypass. |
| 0 0 BYPASS | Clear all bypasses. |
| 9 9 BYPASS (permitted only in service mode) | Bypass all BA1 and BA2 PIDs |

Lines 4271–4273 perform the usual test to make sure keyboard 116 is enabled. Lines 4276–4280 preclude use of the BYPASS button except by an authorized operator with a higher level passcode (i.e., a manager) or a service person (see Table G above). At lines 4282–4292 all bypasses are cleared if 00 BYPASS was entered. The bypass bits are actually cleared by calling the bit clear subroutine (lines 5680–5692). (It will be recalled that after initial processing, the keyboard data stack code for the digit 0 button is the hexadecimal digit A. See the discussion immediately following Table E above, and discussion of lines 4014–4137.) Lines 4295–4298 preclude the 99 BYPASS command unless the system is in the service mode. Lines 4301–4328 bypass all BA1 and BA2 points if the 99 BYPASS command was entered. Lines 4333 et seq. are performed if the bypass command is neither 00 BYPASS nor 99 BYPASS. At lines 4334–4345 the number in the keyboard stack is converted to binary and tested to validate it as the number of a PID which can be bypassed. Lines 4347–4352 fetch the PID identification from PROM 380 (i.e., the information which identifies the type of PID), and lines 4354–4355 make certain that the PID exists. If the PID exists, lines 4357–4359 determine whether or not it is a BA1 PID, and if so, the program jumps to line 4381 where data is set up to cause the PID to be bypassed. Lines 4361–4363 allow non-BA1 points to be bypassed if the system is in the service mode. Lines 4365–4369 disallow any bypassing of fire, supervisory, or hold-up PIDs. Lines 4371–4375 prevent bypassing any BA2 point unless an option stored in PROM 380 allows BA2 bypassing. Lines 4376–4378 prevent any BA2 point from being bypassed while the BA2 protection is on. Lines 4380–4395 bypass the requested point if it is not already bypassed, or remove the bypass from the requested point if it is already bypassed. This display enable bit is used in the display portion of the output routine (lines 2486–2766) to enable display of the number of the bypassed point by seven segment display 114. Line 4397 sets a bit for enabling the bypass display. Lines 4401–4420 are used at the end of the processing of any valid keyboard command. These lines reenable keyboard 116, set up data for subsequently causing a long sounder 118 beep (to acknowledge entry of a valid command), clear the keyboard data stack, and return the program to the calling routine.

Lines 4424–4473: These lines process commands entered via the TEST key on keyboard 116. There are five test functions called by the following keyboard button sequences:

TABLE J

| Keyboard Button Sequence | Test Function |
|---|---|
| 0 TEST | Displays present off-normal PID status. |
| 1 TEST | LED, seven segment display, bell, and sounder test (i.e., preset timers to illuminate all LEDs and seven segment displays and to ring the bell and sound the sounder). |
| 2 TEST | Stores all present off-normal status (i.e., to facilitate a so-called "walk test" in which someone walks through the protcted premises and then comes back to local control unit 102 to see if the expected PIDs signalled alarm conditions). |
| 3 TEST | Bypass display mode (i.e., a test mode in which only bypassed points are displayed). |
| 4 TEST | Takes the system out of any other test mode. |

Lines 4426–4434 validate the test command by making sure that keyboard 116 is enabled and that the digit button operated with the TEST button has a value in the proper range. Lines 4436–4439 clear the bypass display and display enable bits. These are bits which tell the system what test mode to perform. Lines 4441–4449 decode the last digit in the keyboard data stack and cause the program to jump to the program steps for the requested test mode. Lines 4452–4456 are performed if 0 TEST is requested. These lines set the display enable bit and cause the program to jump to a portion of the BYPASS button routine discussed above. The display enable bit is used in the display portion of the output routine (lines 2486–2766) to cause seven segment display 114 to display the information requested by the TEST button request. Lines 4458–4461 are performed if 1 TEST is requested. These lines preset a test timer and then cause the program to jump back to line 4453. Lines 4463–4467 are performed if 2 TEST is requested. These lines set a test latch ("TMLMSK") which is reset at the start of the ON button routine and in the RESET button routine. Again, the program subsequently jumps to line 4453 above. Lines 4470–4473 are performed if 3 TEST is requested. These lines set the bypass display bit and cause the program to jump back to line 4453. If 4 TEST is requested the program jumps to line 4456 without setting any of the display enable, bypass display, or other bits mentioned above.

Lines 4479–4551: These lines process commands entered with the RESET button on keyboard 116. In general, these lines perform the following tasks:

1. Clear the alarm memories;
2. Clear test latch (TMLMSK) set in TEST button routine above;
3. Clear the bypass display and display enable bits;
4. Preset a reset timer;
5. Set a communication reset bit (used to alert communicator module 104 to the fact that the RESET button was operated);
6. Set the silence bit;
7. Cause the program to jump to a portion of the BYPASS button routine discussed above.

There are three reset functions called by the following keyboard button sequences:

TABLE K

| Keyboard Button Sequence | Reset Function |
|---|---|
| RESET | Performs the seven tasks listed immediately above. |
| 0 0 RESET | Disables keyboard 116 by clearing the keyboard enable timer. |
| 9 9 RESET | Causes the "service person off premises" code to be transmitted to central station 106 (to signal that the person who has been servicing the system has left the premises). |

Lines 4485–4510 ascertain that the keyboard data stack contains 99, and if the system is in the service mode, these lines clear the service bit and set up data to send the "service person off premises" code to central station 106. The program then jumps to lines 4525–4527 which disables the keyboard and (by jumping to a portion of the BYPASS button routine discussed above) sets up data to cause sounder 118 to produce a long beep and clears the keyboard data stack. Lines 4512 et seq. are performed if the reset command is not 99 RESET or if the service bit is not set. Lines 4512–4522 validate the reset command as either simply RESET or 00 RESET. Lines 4524–4527 are performed if the command is 00 RESET. These lines are discussed above. Lines 4531 et seq. are performed if the command is simply RESET. Lines 4532–4534 clear the test mode latch. Lines 4536–4538 clear the display enable and bypass display bits. Lines 4540–4541 preset the reset timer, which is used in the point in subroutine to ignore signals from the PIDs for a short time after the RESET button has been operated. This allows time for the system to stabilize after the RESET button has been operated. Line 4545 sets a bit for advising communicator module 104 that the RESET button on keyboard 116 of control unit 102 has been operated. Line 4547 causes the program to jump to a portion of the SILENCE button routine discussed below.

Lines 4557–4578: These lines process the silence command entered via the SILENCE button on keyboard 116. Lines 4560–4561 validate the silence command by ascertaining that keyboard 116 is enabled. If the silence command is invalid, lines 4563–4564 cause the usual response to an invalid command (i.e., the keyboard data stack is cleared and the program continues without acting on or acknowledging the silence command). Lines 4566 et seq. are performed if the silence command is valid. Lines 4567–4573 set two silence bits. The first silence bit (in SYSTM1) silences the bells and sounder 118 which are operating in response to a fire alarm or supervisory alarm. The second silence bit (in SYSTM2) silences the bells and sounder 118 which are operating in response to a BA alarm. Line 4575 ends the SILENCE button routine by jumping to a portion of the BYPASS button routine to perform the functions indicated by the comments at lines 4575–4578.

Main Program—Process Routine

The process routine portion of the main program includes the following parts:

1. Exit timer routine (lines 1928–2119);
2. Late close timer routine (lines 2123–2145);
3. Key pressed counter preset routine (lines 2149–2160);
4. Latch set routine (lines 2164–2171);
5. Clear latches routine (lines 2175–2194);
6. Entry time delay routine (lines 2198–2363).

These routines are discussed in the following sections of this specification.

Main Program—Exit Timer Routine

The exit timer routine (lines 1928–2119) takes care of turning on the BA protection when requested by the subscriber. Typically, the BA protection is turned on and then the subscriber must leave the premises via a "BA movable delayed" exit within a predetermined exit time. This routine makes certain that this happens, and if it does not, this routine deals with the various types of failures that can occur. The program makes two passes through this routine: once for the BA1 system and once for the BA2 system. In the following discussion BAX is used as a generic term for the BA system being processed in a particular pass through this routine.

Line 1930: This line clears flag 0 ("F0") to indicate that the first pass through this routine is made for the BA1 system.

Lines 1932–1942: These lines cause the program to jump to line 2107 if BAX is off.

Lines 1946–1947: These lines clear the late close timer because the protection is on. (As is discussed elsewhere, the late close timer is used to monitor the subscriber's closing time, and to remind him to turn the system on or to advise the central station that the system has not been turned on at the proper time.)

Lines 1949–1965: These lines test the exit time delay register and if it is not zero, decrement it at appropriate time intervals.

Line 1966: This line causes the program to jump to line 1976 if the exit time delay just became zero.

Lines 1968–1969: These lines cause the program to jump to line 2051 if the exit time delay is not yet zero.

Lines 1971–1972: These lines cause the program to jump to line 2119 if the exit time delay is zero. (The comment at line 1971 in the microfiche appendix is incorrect and should read "C=0 EXIT TIME DELAY=0".)

Lines 1975–2046: These lines are performed when the exit time delay just becomes equal to zero. By the time this occurs, the subscriber should have left the premises and the premises should be secure. These lines make certain that this is the case by looking for the following four possible exit conditions (the first three of which indicate that the premises were not properly secured):

1. A door is open (called a "closing trouble" and handled at lines 1976–1990);
2. No one ever left the premises (called an "exit fail" and handled at lines 1997–2025);
3. The wrong door was used by the subscriber in leaving the premises (called a "night set wrong" and handled at lines 2028–2040);
4. None of the above (called a "normal exit" and handled at lines 2042–2046).

Each of these conditions is considered below.

Lines 1976–1990: These lines determine whether any BA protection point is open by checking data regarding the status of the BA protection points which is gathered during the point in subroutine discussed above. If any protection point is open, lines 1986–1990 set up data which will cause a "closing trouble" code to be sent to central station 106.

Lines 1997–2025: These lines determine whether a BA protection point was ever opened while the exit time delay was running. This "exit fail" test can be suppressed by an option stored in PROM 380 called the "exterior option". This option is selected if no exit is to be expected after the BAX system is turned on, as would be the case, for example, if the BA2 system were associated with a safe. Assuming the exterior option is not selected (tested at lines 2000–2001), exit fail data is set up for transmission to central station 106 if the exit bit is not set and no points are bypassed. The exit bit is set in a subsequent portion of the exit time delay routine discussed below.

Lines 2028–2040: These lines set up data for transmitting a "night set wrong" code to central station 106 when the wrong door is used for exit after the BA protection is turned on. The night set wrong bits tested here are set during the entry time delay routine discussed below.

Lines 2042–2046: These lines set up the data for sending a normal closing code to central station 106.

Lines 2050–2101: These lines control setting the exit bit which is used earlier in the exit timer routine to check for an exit fail condition. An option stored in PROM 380 allows the system to be set up for either single or multiple exits. If the single exit option is selected, the exit timer is set to zero at lines 2098–2101 as soon as a door has been opened and then closed. If the multiple exit option is selected, the exit time delay is allowed to expire normally. If the exit bit is already set, line 2061 causes the program to jump to 2083. Otherwise, lines 2063–2069 determine whether any movable BA protection point is in alarm, and if so, lines 2071–2078 set the BA1 and BA2 exit bits. The multiple exit option is checked at lines 2081–2085, and if that option is selected the program jumps to line 2119 to allow the exit time delay to continue to expire normally. If the multiple exit option is not selected, lines 2087–2095 determine whether any movable BA protection point is currently in alarm. If so, the program jumps to line 2119 to allow the exit time delay to continue to expire normally. If no movable BA protection point is currently in alarm, lines 2098–2101 clear the exit time delay register and cause the program to jump back to the logic which is performed when the exit time delay register just becomes zero.

Lines 2104–2119: These lines are performed if BAX is off. Line 2107 presets the exit time delay register. Line 2109 clears the night set wrong bit, the exit bit, and the redundant bit. Lines 2111–2117 set up control data needed for the second (BA2) pass through the exit timer routine if the pass just completed is the BA1 pass.

Main Program—Late Close Timer Routine

The late close timer routine (lines 2123–2145) controls the late close timer register. This register is used to measure the elapsed time since the BA protection was turned off so that an alarm can be sent if the BA protection is not turned on again after the normal number of hours (e.g., after a normal working day). As discussed above, a different than normal number of hours can be entered into the late close timer register using the digits and HOURS buttons on keyboard 116 (see discussion of lines 4213–4264 above). The late close timer register also controls sounder 118 to produce an audible sound as a reminder to the subscriber that the late close timer register is about to expire and that the BA system should therefore be turned on or the closing time extended using the digits and HOURS buttons mentioned above. Lines 2125–2128 test the late close timer register, and if the late close timer register is still non-zero, call a subroutine at line 2128 for decrementing that register at appropriate time intervals. When the late close timer register is decremented to zero, lines 2129–2133 set up data for sending a no close alarm to central station 106. It is to be noted that the system only sends information to central station 106 representative of the fact that the closing time has been extended. The system does not advise the central station of the amount of the time extension or of any new closing time. Lines 2134–2142 cause the program to jump back to line 1932 for another pass for BA2 if the pass just completed is for BA1.

Main Program—Key Pressed Counter Preset Routine

Lines 2149–2160: These lines preset a counter register to a given number each time a predetermined time interval has elapsed. The contents of this register are decremented every time a keyboard 116 digit key is depressed, and, as discussed above in connection with the combo routine of the key in subroutine (lines 4014–4137), digit key data is only accepted as long as this register is not zero. In this way rapid entry of a large number of digit combinations in the hope of finding a valid combination is prevented.

Main Program—Latch Set Routine

In the point in subroutine discussed above, status bits were set to indicate the current status of the various PIDs. Certain status bits must be saved even if the PID which caused them to be set goes out of alarm. The latch set routine (lines 2164–2171) saves these status bits in a latch memory. The status bits saved are fire alarm ("FA") and BA1 and BA2 movable delayed alarms. The FA status bit is saved to make certain that the local bell continues to ring and a fire alarm is sent to central station 106 even if a fire alarm point goes out of alarm. The BA1 and BA2 movable delayed status bits are saved because the fact that a door was opened indicates a need to continue decrementing the entry time delay register even after the door has been closed.

Main Program—Clear Latches Routine

The clear latches routine (lines 2175–2194) clears the BAX movable delayed latch if BAX is off.

Main Program—Entry Time Delay Routine

This routine (lines 2198–2363) allows a subscriber to enter the premises via an entry with BA movable delayed protection while the BA protection is on and gives him a predetermined time to enter his passcode via keyboard 116 (BA1 or linked BA1 and BA2) or remote BA2 keyswitch module (non-linked BA2) to turn off the associated BA protection.

Lines 2202–2213: These lines determine whether BAX is on. If BAX is off, the program jumps to line 2356.

Lines 2216–2228: If BAX is on and a BA fixed protection point is in alarm (as indicated by the BA fixed status bit), these lines cause the program to jump to line 2320 which ultimately results in the transmission of an alarm signal.

Lines 2231–2243: If BAX is on and there is no BA fixed alarm, these lines cause the program to jump to line 2320 if there is a movable instant alarm and the exit time delay has expired. This ultimately results in transmission of an alarm.

Lines 2245–2254: If there is a movable instant alarm and the exit time delay has not expired, these lines set the night set wrong bit which causes the system to tell central station 106 that the subscriber turned on the BA system and then left the premises via a BA movable instant protection point instead of a BA movable delayed protection point. (See the discussion of lines 2028–2040 above.)

Lines 2257–2288: These lines preset the entry time delay register unless the movable delayed latch indicates that there has been a BA movable delayed alarm. If such an alarm has occurred, these lines cause the entry time delay register to be decremented each time a predetermined time interval has elapsed.

Lines 2290–2297: These lines cause the program to jump to various lines depending on the value remaining in the entry time delay register.

Lines 2300–2316: These lines are performed if the entry time delay register just became zero. These lines preset the bell ring timer to cause the local alarm bell to ring.

Lines 2319–2325: These lines (and subsequent lines) are performed if the entry time delay register is zero. These lines clear the BA movable delayed latch which has now served its purpose.

Lines 2327–2338: These lines move the alarm memory buffer (which stores potential alarms, e.g., alarms which are not recognized as alarms until expiration of the entry time delay) to the alarm memory if the alarm memory was previously empty. The system is designed to save and display only the first alarm condition which caused the system to go into alarm.

Lines 2340–2351: If an alarm was moved into the alarm memory as described immediately above, and if the redundant bit is not set, these lines set up data to cause transmission of an "unverified entry signal" to central station 106.

Lines 2354–2356: These lines are processed only if BAX is off. This line presets the entry time delay register.

Lines 2358–2363: These lines cause the program to jump back to the start of the entry time delay routine to start a BA2 pass after completing a BA1 pass.

Main Program—Output Routine

The main program output routine (chiefly lines 2367–3831) sets up output data for use in controlling the various outputs of the system including LED display 112, seven segment display 114, sounder 118, the commandable output PIDs, the bell PID, the BA2 remote keyswitch module, and relay and test devices 402 and 404 (FIG. 4). The output routine also sets up output data for controlling the C line signals and the alarm and other information going to communicator module 104 for transmission to central station 106.

Lines 2369–2374: These lines clear two temporary registers which are used during the output routine to control outputs discussed below.

Lines 2377–2383: These lines decrement the auto test timer register and set up data to energize test device 404 (FIG. 4) if the auto test timer register is greater than a predetermined minimum. As described above, test device 404 tests the backup battery while the AC power is on to assure that the battery is ready in the event of an AC power failure. The auto test timer is preset whenever the BA protection is turned off (i.e., during the key in subroutine at line 4669). Because the BA protection is normally turned off and on at regular intervals (e.g., once a day), this results in sufficiently frequent battery tests. The auto test timer is compared to a non-zero minimum so that test device 404 will only be energized during part of the auto test time interval. When test device 404 is energized, the voltage of the AC power supply output signal is reduced to effectively place the system on battery power. If the battery is weak, low battery detector 376 (FIG. 4) will detect that fact and apply an appropriate low battery signal to microcomputer 350. This low battery information is transmitted to central station 106.

Lines 2385–2395: These lines decrement a lamp test timer register (which is preset at line 4459 in the TEST button routine discussed above) and set up data to cause all the LEDs in displays 112 and 114 to turn on if the lamp test timer register is not equal to zero. This will occur in response to a 1 TEST request entered via keyboard 116 (see Table J and accompanying discussion above).

Lines 2398–2401: These lines set up data to cause a commandable output PID ("COP") to respond as part of a test of the system. For example, if the BA2 system includes microphones for protecting a vault, these lines set up data to energize a buzzer in the vault as a test of that portion of the BA2 system. Line 2401 causes the program to jump to the sounder routine discussed below.

Lines 2408–2482: These lines set up data to control the LEDs in LED display 112. The LEDs controlled by this routine include DS1 (BA1 protection on), DS2 (common trouble), DS3 (communication failure), and DS4 (AC power failure). (See also Table C above.)

Lines 2412–2417: These lines control a bit in temporary register R3 which ultimately controls LED DS1 to indicate whether or not the BA1 protection is on. The data in register R3 is later moved to output register DMB0 which is used in the timer interrupt routine (discussed below) to actually control whether or not LED DS1 is energized. This sequence of LED data processing is typical for all LEDs and will not be repeated below.

Lines 2423–2449: These lines control a bit in temporary register R3 which ultimately controls LED DS4 to indicate whether or not the AC power is on. Lines 2424–2433 turn on LED DS4 when the AC power is on, while lines 2437–2449 turn on LED DS4 when the AC power is off. The second alternative is the one used in the embodiment shown in the drawing.

Lines 2455–2466: These lines control a bit in temporary register R3 which ultimately controls LED DS2 to indicate whether any of faults 2-6 (FALT 26) have been detected. These are the faults numbered 2-6 in Table H above.

Lines 2470–2482: These lines control a bit in temporary register R3 which ultimately controls LED DS3 to indicate whether or not a telecommunication failure has been detected. LED DS3 has steady illumination if communicator module 104 is signalling that there is a failure of the communication link with central station 106 (fault 1 in Table H above). LED DS3 has flashing illumination if control unit 102 is unable to communicate with communicator module 104 (fault 8 in Table H above). The flashing illumination is achieved by logically combining the FALT 8 data with cyclic CLOCK data at lines 2472–2474.

Lines 2486–2766: These lines set up data for controlling seven segment display 114 and the related LEDs. Display 114 is used to display the following information: the contents of the alarm memory registers (lines 2503–2609); the number of hours in the late close timer register (lines 2613–2619); the numbers of the off-normal points (lines 2624–2766).

Lines 2486–2495: These lines increment a scroll pointer which is used to step the seven segment display through displays of successive items of information. The scroll pointer is incremented at a frequency which allows the subscriber sufficient time to read each item of displayed information without requiring an undue amount of time for all of the information to be displayed. The scroll pointer is used to scroll through the alarm memory registers (lines 2503–2609) and through the off-normal points (lines 2624–2766).

Lines 2497–2500: These lines cause the program to jump to the appropriate logic for displaying (1) the contents of the alarm memory registers (lines 2503–2609), (2) the number of hours in the late close timer register (lines 2613–2619), or (3) the numbers of the off-normal points (lines 2624–2766).

Lines 2503–2609: These lines set up data for causing display of the contents of the alarm memory registers. Lines 2503–2514 assure that the scroll pointer is in the proper range for addressing the seven alarm memories (see lines 88–94 and Table D above). As discussed above, each of these alarm memories contains the number of the first alarm of the type associated with that memory. Lines 2516–2524 search all seven alarm memory registers for a register containing some alarm information. If all alarm memories are empty, lines 2528–2547 are performed. Lines 2528–2533 clear temporary register R2 if BA1 is on. If BA1 is off, lines 2536–2544 set up data for turning on bypass LED DS9 if any point is bypassed. Lines 2551 et seq. are performed if alarm information was found in any of the alarm memories. Lines 2551–2609 transfer the contents of the alarm memory containing alarm information to a temporary register for ultimately controlling display 114. These lines also set up corresponding data for simultaneously illuminating the LED which corresponds to the type of alarm condition causing the seven segment display. (Part of this logic prevents the display of security alarms if the so-called Canada option is selected in PROM 380. This may prevent an intruder from realizing that the system has detected the intrusion and may increase the likelihood that the intruder can be captured while still on the premises.)

Lines 2613–2619: These lines set up data for ultimately causing display 114 to display the contents of the late close timer register.

Lines 2624–2766: These lines control the display on display 114 of the numbers of the PIDs detected as having off-normal status. Lines 2631–2646 make certain that the scroll pointer discussed above in relation to lines 2486–2495 is within the limits of the off-normal PID memory locations. Lines 2648–2657 search the PID memory locations for an off-normal point. If no off-normal point is found, lines 2659 et seq. are performed. If an off-normal point is found, lines 2681 et seq. are performed. Lines 2659–2662 set up data which ultimately causes display 114 to display two dashes. Lines 2664–2670 further process the data from lines 2659–2662 and add data which ultimately causes appropriate LED illumination concurrent with the seven segment display. Lines 2681–2766 are performed when an off-normal point is found. These lines set up data to cause display 114 to display the number of the off-normal point. Lines 2723–2742 convert the binary point number to binary coded decimal ("BCD"). Lines 2787–2797 are a look-up table for converting each binary coded decimal digit of the point number to data appropriate for causing display 114 to display that decimal digit.

Lines 2770–2954 (excluding lines 2787–2797 discussed above): These lines set up temporary register data which ultimately controls sounder 118 (sometimes called "SONALERT" in the comments in the microfiche appendix). The following conditions (dealt with at the indicated lines) cause or may cause sounder 118 to be energized:

1. Operation of any key on keyboard 116 (lines 2772–2782);
2. A fire alarm (lines 2816–2831);
3. A trouble (i.e., any of faults 1–8 in Table H above, or a supervisory PID alarm or trouble, or a trouble in a fire alarm PID) (lines 2834–2863);
4. A BA fixed alarm (lines 2873–2888);
5. The BA1 movable delayed latch equals one, which means that a protection point (e.g., a door) associated with a movable delayed PID has been opened while the BA protection is on (lines 2897–2901);
6. The entry time delay register equals zero, which means that someone has entered the premises via a movable delayed protection point while the BA protection is on and has not entered a valid passcode before expiration of the entry time delay (lines 2904–2907);
7. The BA1 bell timer register is not equal to zero, which means that the burglar alarm bell is ringing (lines 2909–2920);
8. The exit time delay register indicates that only a relatively short time remains before expiration of the exit time delay (lines 2923–2932). This feature is provided to warn the subscriber that he has not left the premises promptly enough after turning on the BA protection and that he should therefore turn off the protection and start his closing procedure over again;
9. The late close timer register indicates that only a relatively short time remains before expiration of that timer (lines 2934–2941). This feature is provided to warn the subscriber that he has not closed the premises at the expected time and that if he wishes to extend his closing time, he should add an appropriate amount of time to the late close timer register using the HOURS button on keyboard 116, or if he does not wish to extend his closing time, he should turn the protection on.

Note that in general the program tests for the foregoing conditions in the order mentioned above and only performs the program steps for the first condition having a true state. In this way, sounder 118 is only being used for one function at any given time and the subscriber is not subjected to overlapping and therefore confusing sounder signals.

Figure 8:
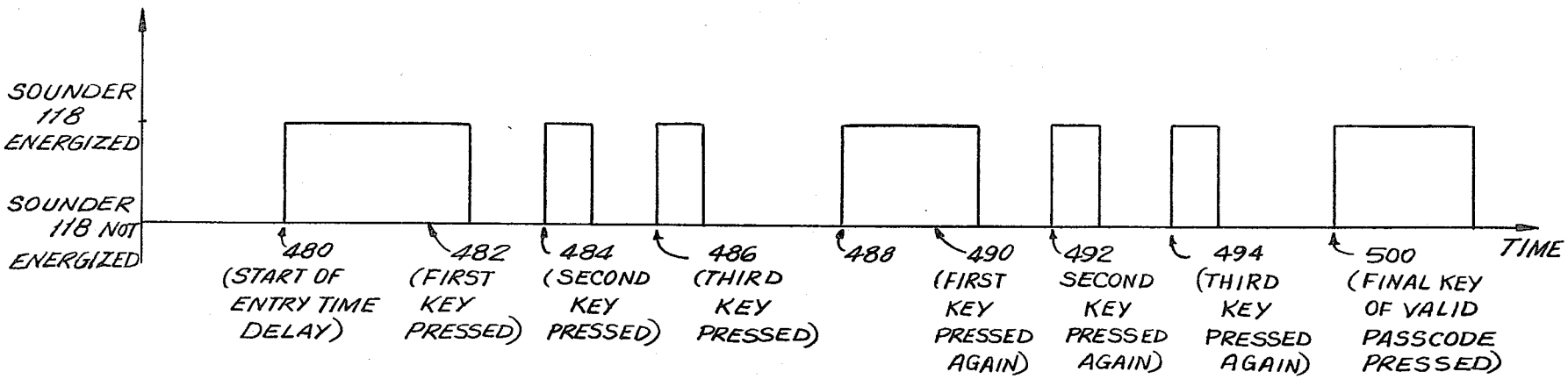
FIG. 8 is a diagram illustrating the operation of the audio sounder which is part of the local control unit of this invention.

An illustrative sequence of energization of sounder 118 is shown in FIG. 8. At the start of this sequence the BA protection is assumed to be on. Prior to point 480, sounder 118 is not energized. As soon as someone enters the premises via a movable delayed protection point at time 480, the sounder is continuously energized until a short time after the first digit key is operated on keyboard 116 at time 482. Sounder 118 is then quiet until, at time 484, the second digit key is operated on keyboard 116. Thereafter, sounder 118 is energized briefly to acknowledge the second digit key operation. At time 486, sounder 118 is again energized briefly to acknowledge the third digit key operation. If the fourth (or any other) digit key is not operated within a predetermined maximum time from the preceding digit key operation (e.g., at time 488 in FIG. 8), the data entered thus far is cleared from the keyboard data stack and sounder 118 is continuously energized until the entry of keyboard digits begins again (e.g., at time 490). At times 492, 494, etc., short pulses of sounder 118 are produced to acknowledge subsequent digit key operations until the final digit of a valid passcode is entered (at time 500). The entry of a valid passcode is acknowledged with a longer pulse of sounder 118. Thereafter, sounder 118 is silent until required to indicate some other event or condition.

Lines 2772–2782 and 2801–2811: These lines test the sounder timer which is preset whenever any key on keyboard 116 is operated. Lines 2773 et seq. are performed if the sounder timer is not zero. Line 2773 decrements the sounder timer at predetermined time intervals. Lines 2777–2779 set up data to disable the sounder if the sounder timer register contains less than a predetermined midpoint value. The combination of the two preceding functions produces the short sounder pulse to acknowledge operation of each keyboard key. If the sounder timer register is decremented to zero, lines 2801–2811 are performed and clear the keyboard data stack. This is the function illustrated at time 488 in FIG. 8. (At line 2809 the hours display enable bit is cleared when the sounder timer register is zero because the sounder timer register is used to time the hours display (see discussion of lines 4262–4264 above).) Sounder 118 comes on again at time 488 in FIG. 8 because lines 2897–2901 below are processed.

Lines 2816–2831: These lines are processed to set up data for energizing sounder 118 if there is a fire alarm, if the system is not silenced for fire alarms, and if a cyclic clock bit is set. This causes sounder 118 to pulse on and off while there is an unsilenced fire alarm.

Lines 2834–2863: These lines are performed if there is a trouble of the type identified above in relation to these lines. These lines set up data for energizing sounder 118 if there is a trouble, if the system is not silenced for fire alarms, and if two cyclic clock bits are set. The frequency of one of these clock bits is twice the frequency of the other so that these lines cause two closely spaced sounder pulses, followed by a pause, followed by two more closely spaced sounder pulses, followed by a pause, and so on.

Lines 2866–2869: These lines are performed if there are no fire alarms or troubles of the type mentioned above. These lines clear the fire alarm silence bit so that a SILENCE button request is automatically nullified if there is nothing to silence.

Lines 2873–2888: These lines set up data for causing a continuous sounder output if there is a BA fixed alarm and the system is not silenced for BA alarms.

Lines 2892–2895: These lines are performed if there are no BA fixed alarms. These lines clear the BA fixed alarm silence bit so that a SILENCE button request is automatically nullified if there is nothing to silence.

Lines 2897–2901: These lines set up data for causing a continuous sounder output if there is a BA1 movable delayed alarm.

Lines 2904–2907: These lines set up data for causing a continuous sounder output if the BA1 entry time delay register has expired (i.e., is equal to zero).

Lines 2909–2920: These lines set up data for causing a continuous sounder output while the BA1 bell is ringing (i.e., while the BA1 bell timer is not equal to zero).

Lines 2923–2932: These lines set up data for causing a continuous sounder output when the exit time delay register indicates that only a relatively short time remains before expiration of the exit time delay so the subscriber will have time to turn off the BA protection and restart his closing procedure before an alarm is produced.

Lines 2934–2941: These lines set up data for causing a continuous sounder output a short time prior to expiration of the late close timer so that the subscriber is reminded to either close the premises or enter additional time into the late close timer using the HOURS button.

Lines 2943–2954: These lines set a "sounder on" bit in a temporary register whenever any of the foregoing logic indicates that sounder 118 should be energized.

Lines 2958–3123: These lines set up data for controlling commandable output PIDs or COPs 4–10. (For convenience, the functions of COPs 0–3 are also tabulated below.) Like other PIDs, each COP has a P latch and a K latch. The functions of the 11 COPs and their P and K latches are as follows (see also lines 539–584):

TABLE L

| PID or COP No. | Latch | Function |
|---|---|---|
| 0–3 | P and K | Commandable by central station 106. These COP latches can be used for any of a wide variety of functions under control of central station 106 (e.g., to turn on or off lights, heat, air conditioning, or fans, to conduct remote tests of the BA or FA systems, etc.). The logic for handling these central station commands is in the so-called timer interrupt routine discussed below. |
| 4 | P | Controls lighting in response to the BA1 system. Lights connected to this COP latch are automatically turned on during the BA1 entry time delay and remain on until expiration of the BA1 exit time |

TABLE L-continued

| PID or COP No. | Latch | Function |
|---|---|---|
| | | delay, at which time they are automatically turned off. These lights are also turned on automatically in response to any BA1 alarm. |
| 4 | K | Same as above for BA2. |
| 5 | P | Ring a bell whenever there is a BA1 fixed alarm. |
| 5 | K | Same as above for BA2. |
| 6 | P | The state of this latch indicates whether the BA1 system is on or off. This latch can therefore be used to control any function dependent on the state of the BA1 system. For example, this latch could by used to switch a thermostat from one setting to another so that heating or cooling levels are changed in dependence on whether the premises are open (BA1 off) or closed (BA1 on). |
| 6 | K | Same as above for BA2 |
| 7 | P | The state of this latch indicates whether or not a fire alarm has been detected. This latch can therefore be used for such functions as closing a fire door, shutting off blowers which might cause smoke to spread, etc. |
| 7 | K | Same as above for supervisory alarms. This latch can be used for such functions as turning on a pump or valve in response to a supervisory alarm. |
| 8 | P | The state of this latch indicates whether or not there is a holdup alarm. This latch can therefore be used to turn on a holdup camera, a video tape recorder, etc., when there is a holdup alarm. |
| 8 | K | Not used. |
| 9 | P | The state of this latch indicates whether sounder 118 of local control unit 102 is on or off. This latch can therefore be used to control another sounder remote from control unit 102. |
| 9 | K | Not used. |
| 10 | P | The state of this latch indicates whether or not a "1 or TEST" request has been made via keyboard 116 of local control unit 102. This latch is therefore used to turn on a remote sounder as part of the system test requested by entry of the "1 TEST" command. |
| 10 | K | Not used. |

Because COPs only receive commands from local control unit 102 and do not transmit data back to the local control unit, any number of COPs of any given type can be connected to cables 108*a*, 108*b*. For example, if two remote sounders are required, two COPs of type 9 can be connected to cables 108*a*, 108*b* and both of these COPs will operate in tandem.

Lines 2958–2981: These lines set up data (i.e., a bit) which ultimately turns on the P latch of COP 4 when any one of the following BA1 conditions is satisfied:

1. The BA1 movable delayed latch equals 1 (indicating that the BA1 protection is on and someone has entered the premises via a BA1 movable delayed protection point);
2. The BA1 bell ring timer is not equal to zero (indicating that someone has broken into the premises while the BA1 protection was on);
3. The BA1 exit timer is not equal to zero (indicating that the BA1 protection is off or that the BA1 protection has just been turned on and the time for the subscriber to leave the premises has not yet expired).

Register R3 is used as a temporary register for accumulating bits which ultimately control the P and K latches of COPs 4–7 (see lines 554–569 for the significance of the various bits). Thus at line 2979 bit 0 (the right-most bit) in register R3 is set if any of the foregoing conditions are satisfied.

Lines 2985–3005: These lines are similar to lines 2958–2981, but set up a bit for turning on the K latch of COP 4 in response to the specified conditions of the BA2 system.

Lines 3009–3020: These lines set up a bit for turning on the P latch of COP 5 whenever the BA1 fixed alarm memory is not equal to zero.

Lines 3024–3035: These lines set up a bit for turning on the K latch of COP 5 whenever the BA2 fixed alarm memory is not equal to zero.

Lines 3039–3049: These lines set up a bit for turning on the P latch of COP 6 whenever the BA1 system is off.

Lines 3052–3062: These lines set up a bit for turning on the K latch of COP 6 whenever the BA2 system is off.

Lines 3067–3079: These lines set up a bit for turning on the P latch of COP 7 whenever there is a fire alarm.

Lines 3084–3094: These lines set up a bit for turning on the K latch of PID 7 whenever there is a supervisory alarm.

Lines 3096–3099: These lines transfer the central station command bit for COPs 0–3 to output buffer register 1 ("OPPB1").

Lines 3101–3104: These lines transfer the control bits for COPs 4–7 from register R3 to output buffer register 2 ("OPPB2").

Lines 3108–3116: These lines set up a bit for turning on the P latch of COP 8 whenever there is a holdup alarm.

Lines 3118–3123: These lines combine the holdup bit for COP 8 with the data for controlling COPs 9 and 10 and store the result in output buffer register 3 ("OPPB3"). The COP 9 data is set up in the sounder routine (lines 2770–2954) discussed above, and the COP 10 data is set up at the beginning of the output routine (i.e., at lines 2398–2399) also discussed above.

Lines 3127–3202: These lines control the bell PID (i.e., PID 15). The P output of PID 15 drives a pulser which turns the bell on and off during alternating time intervals. This is used as a fire alarm warning. The K output of PID 15 causes the bell to ring continuously. This is used as a burglar alarm warning. The fire alarm warning, if any, must override any burglar alarm warning. Lines 3128–3131 cause the program to jump over all the burglar alarm bell logic if there is a low battery condition. Lines 3133–3143 clear the BA1 bell ring timer and preset the BA1 bell recycle counter to 4 if the BA1 system is off. The BA1 bell recycle counter is decremented by one each time the bell rings in response to a BA1 alarm to limit the number of times during any period in which the BA1 system is on that the bell will ring. Line 3145 decrements the BA1 bell ring timer each time a predetermined time interval has passed unless the bell ring timer is already zero. Line 3147 tests the BA1 bell ring timer and causes the program to jump if the timer is zero. Lines 3149–3151 and 3180 et seq. set up data for ultimately energizing the K latch of PID 15 unless the BA1 bell recycle timer is equal to zero. Lines 3153–3171 are similar to the preceding lines for the BA2 system. Lines 3173–3177 set up data which ultimately causes the bell to ring during auto test (i.e., whenever the BA system is turned off) or during 1 TEST which, as discussed above, is one of the test functions called by operating the TEST button on keyboard 116. Lines 3182–3184 cause the program to jump the fire alarm warning bell logic if the system has been silenced (using the SILENCE key on keyboard 116 as discussed above) or if it is in the service mode (as a result of entry of a service passcode via keyboard 116 as also discussed above). Lines 3186–3193 set up data which ultimately energizes the P latch of PID 15 if there is a fire alarm. Lines 3195–3200 logically combine the P and K latch data for PID 15 so that if there is a fire alarm, the P latch data overrides any K latch data.

Lines 3206–3253: These lines set up data for controlling the P and K latches of the BA2 keyswitch module (PID 14). The BA2 keyswitch module (not shown in detail) has a green LED, a red LED, and a sounder similar to sounder 118 in local control unit 102. The BA2 keyswitch module logically combines the states of its P and K latches in accordance with the following table:

TABLE M

| P Latch | K Latch | BA2 Keyswitch Outputs | Condition Indicated |
|---|---|---|---|
| 0 | 0 | None | None. |
| 0 | 1 | Green LED | The BA2 protection is on. |
| 1 | 0 | Red LED | A BA2 protection point is open and the BA2 protection cannot be turned on until the open point is closed. |
| 1 | 1 | Green LED; Red LED; Sounder | The BA2 system is on and a BA2 movable delayed protection point is open; sounder warns the subscriber to turn the BA2 protection off. |

Lines 3206–3253 set up data for controlling the P and K latches of PID 14 so that those latches represent the conditions described above.

Lines 3257–3282: These lines set up data for controlling relay device 402 in FIG. 4. As mentioned above, relay device 402 is used to send alarms directly to a police department facility. These lines cause relay device 402 to be de-energized if there is a BA1 or BA2 alarm and the respective BA1 or BA2 redundant bit is set.

Lines 3298–3512: These lines set up ten data bits which are part of 16 data bits (two bytes) transmitted to central station 106 via communicator module 104. The other six bits of this data are the passcode information (i.e., one of 64 passcodes representing such information as the identity of the subscriber who opened or closed the premises, the identity of the service person who is on the premises, etc.) which is selected appropriately elsewhere throughout the program. A complete list of the types of information represented by the passcodes is provided by the comments at program listing lines 250–286. The ten bits of data set up by the program lines now being discussed are identified at lines 385–401. Register R3 is used as a temporary storage register for accumulating the appropriate bits. Lines 3298–3311 set up the holdup data bit if any holdup PID is in alarm or if the hostage bit is set as a result of entry of the hostage code via keyboard 116. Lines 3315–3321 set up the supervisory alarm bit if there is a supervisory alarm. Lines 3327–3334 set up the fire alarm bit if the fire alarm latch is set. Lines 3338–3357 set up the fire alarm trouble bit if there is a fire alarm PID trouble or if a fire alarm point has been bypassed and the system is not in the service mode. Lines 3361–3377 set up the BA1 and BA2 off bits if the corresponding BA system is off. Lines 3381–3422 set up the BA1 and BA2 alarm bits if (1) the corresponding entry time delay equals zero and the corresponding redundant bit equals 1, or (2) there is a corresponding BA fixed alarm. Lines 3427–3465 transfer the data accumulated in temporary register R3 as described above and transfer it to communicator output register ("STAB1" for the first communicator module, and "STAB2" for the second communicator module (which is not present in the embodiment herein disclosed)). These lines also keep track of what data has been read by the communicator module so that data is not destroyed until it has been read, and also so that after data is read it is erased and is therefore not read again. Lines 3469–3494 set the system trouble bit whenever any of the following conditions occur: (1) any of faults 1–6 (see Table H above), (2) a supervisory PID trouble, or (3) a supervisory PID is bypassed and the system is not in the service mode. The system trouble bit is added to the byte including the six-bit passcode. Lines 3498–3512 set the tamper bit if a tamper has been detected. The tamper bit is also added to the byte including the six-bit passcode. (The reference to a third byte here relates to setting up data for a type of communicator module which is not used in the embodiment disclosed herein. This is a type of communicator module which cannot transmit the passcode information.)

Lines 3515–3520: These lines cause four bits in output register OPR1 to be transferred from microcomputer 350 to port 4 of input/output expander 400. These four bits control relay device 402, test device 404, spare device 406 (not used), and sounder 118.

Lines 3524–3590: These lines control the P latch or power output of PIDs 16–63. This is the output which supplies power to the sensor connected to the PID. The ability to turn off the power output of the PIDs is used (1) to automatically disconnect power-consuming BA sensors when low battery is detected or during a prolonged AC power outage to conserve remaining battery power for extending more important fire alarm protection and (2) to reset sensors (e.g., glass breakage and smoke detectors) that latch when triggered and are reset by momentarily removing power. Lines 3524–3549 test certain conditions for disconnecting the BA load. These are (1) low battery condition and auto test timer equal to zero (which means that the system is not in the test mode which automatically occurs whenever the BA protection is turned off), or (2) the AC power has been off for more than a predetermined time interval and the disconnect option (stored in PROM 380) is equal to one. Lines 3551–3564 are performed only when neither of the two preceding conditions is present. These lines set up data for momentarily de-energizing the P outputs of the following PIDs during the first part of the reset timer cycle (initiated by operating the RESET key on keyboard 116): (1) if the system is in the service mode, the P outputs of all PIDs are momentarily de-energized, or (2) if the system is not in the service mode, the P outputs of all fire alarm PIDs are momentarily de-energized. The subscriber is not able to reset latching BA PIDs because he might do so and thereafter incorrectly assume the premises could be secured. For example, a latching glass breakage sensor might be resettable and thereafter appear normal even though the associated glass had been largely broken out. Resetting such a sensor would produce a false indication that the premises could be secured. Thus only a service person is allowed to reset BA sensors. Lines 3566–3590 combine the data set up above with the data which identifies each PID by type to set up further data which is used in the timer interrupt routine (discussed below) to actually command each PID to turn off its P output if appropriate.

Lines 3595–3829: These lines control communication with communicator module 104. As mentioned previously, the program has the capability of controlling communication with two communicator modules, but the disclosed embodiment uses only a single such module. Thus only communication with one communicator module will be discussed below.

Lines 3606–3608: These lines select the communicator module to be used for communicating with central station 106.

Lines 3610–3613: Communicator module 104 includes a status register which is set by the communicator module and read by control unit 102. The significance of the bits in the communicator status register is indicated by lines 351–360. Line 3610 addresses the communicator status word, and lines 3612–3613 store that word in a temporary register.

Lines 3615–3616: These lines test the communicator status word to make certain that a communicator module is connected to control unit 102. If a module is present, there is always at least one zero in the status word. In the absence of a module, pull-up resistors 364 substitute ones for the data which would otherwise come from the communicator module. The presence of all ones in the temporary register therefore indicates the absence of a communicator module.

Lines 3618–3621: These lines are performed if there is no communicator module. These lines test a bit which is set whenever a communicator module is present in order to determine whether the absence of the communicator module means that the module has been removed.

Lines 3623–3625: These lines set a so-called dead dialer bit if the communicator module did exist and is now missing. The program then skips the rest of the lines relating to the communicator module.

Lines 3630–3633: If the communicator module is present, these lines set a bit to indicate that this is the case.

Lines 3634–3643: These lines select the communication trouble passcode if the communicator status word includes the bit which signals communication trouble.

Lines 3645–3657: These lines check the communicator status word for the ring back request bit, and if that bit is set, these lines set up data for ultimately causing sounder 118 to emit a short beep. The ring back sounds each time central station 106 acknowledges receipt of a closing signal from communicator module 104 so that the subscriber knows that information has been received by central station 106.

Lines 3658–3662: In addition to a status register, communicator module 104 includes an output buffer register which contains data to be transmitted to local control unit 102. These lines test the output buffer register full bit of the communicator status register, and if that bit is set, there is data in the output buffer register.

Lines 3667–3670: These lines are performed if there is data in the communicator output buffer register. These lines input that data and save it in register R1. The communicator output data is used in one of four possible ways as follows, depending on the states of the F0 and F1 bits in the communicator status word:

TABLE N

| F0 | F1 | Function |
|---|---|---|
| 0 | 0 | Interpret the communicator output data as a data RAM address and read from the data RAM the data at that address. |
| 0 | 1 | Same as above except that communicator output data is interpreted as an address in PROM 380. |
| 1 | 1 | Write the communicator output data into register WRTAR1. |
| 1 | 0 | Write the communicator output data into the RAM address specified by the contents of register WRTAR1. |

Lines 3672–3673: These lines test the F0 bit in the communicator status word to determine whether to read or write data.

Lines 3676–3677: If the request is to read data, these lines test the F1 bit in the communicator status word to determine whether to read data from PROM 380 or the data RAM in microcomputer 350.

Lines 3680–3775: These lines are performed if data is to be read from the data RAM. There are three types of RAM data reading that can occur as follows:

1. Read data from the specified RAM location. (This is a so-called regular RAM read and is essentially performed by lines 3711–3714.)
2. Read data from the specified RAM location and erase that data from the specified RAM location. (This is a so-called status request and it is commanded by communicator output data equal to 61H. Lines 3703–3704, 3716–3728, and 3770–3775 basically perform this function.)
3. Read the local control unit passcode data. (This is a so-called field request and it is commanded by communicator output data equal to 60H. Lines 3694–3701 and 3732–3775 basically perform this function.)

The only one of the foregoing reading operations requiring detailed discussion is the third or field request operation. The field request operation returns a byte to communicator module which is a six bit passcode number (bits 2–7), together with the system trouble bit (bit 0) and the tamper alarm bit (bit 1). The passcode number is derived by stepping through the 64 bits of an eight-byte passfield (lines 116–123), each of which bits is set elsewhere in the program to represent a particular passcode (see discussion of lines 5696–5732 below). The meaning of the various passcodes is indicated by the comments associated with lines 250–286. The program counts the bits as it steps through the eight-byte passfield. The passcode number given to communicator module 104 is the number of the first set bit encountered in this process. This bit is reset so that it does not cause the same passcode to be transmitted again. Lines 3732–3752 search the eight-byte passfield for the first non-zero bit. Lines 3758–3763 clear the non-zero bit from the passfield byte in which it was found. Lines 3765–3768 combine the six-bit passcode number with the tamper and system trouble bits. Lines 3772–3773 transfer the data to communicator module 104.

Lines 3779–3790: These lines are performed if the communicator status word is requesting that data be read from PROM 380. These lines read from the PROM address specified by the contents of the output buffer register and transmit that PROM data back to communicator module 104.

Lines 3795–3814: These lines handle the two data writing functions listed in Table N above. Line 3803 tests the F1 bit in the communicator status word. Lines 3805–3810 are performed if the F1 bit is zero. These lines write the data in the communicator output buffer register into the RAM address specified by the contents of register WRTAR1. Lines 3812–3814 are performed if the F1 bit is one and transfer the contents of the communicator output buffer register into register WRTAR1.

Lines 3817–3827: These lines repeat the communicator module logic for the second communicator module, if there is a second such module (which there is not in the particular embodiment shown herein).

Line 3831: This is the last line of the main program. It causes the program to jump back to the start of the main program (line 1560) for another pass through the main program.

Timer Interrupt Routine

At regular time intervals processing of the main program is interrupted and program control jumps to a so-called timer interrupt routine which begins at line 675. The principal functions of the timer interrupt routine are (1) to update, at appropriate time intervals, several timing bits used in the main program to time various operations such as the exit and entry time delays, (2) to input data from keyboard 116 and to drive displays 112 and 114, and (3) to control the S and C line signals which are used for communication with the PIDs.

As will be described in detail below, the initial portion of the timer interrupt routine (i.e., lines 675–881) is performed every time the main program is interrupted as has just been described. This portion of the timer interrupt routine handles updating the timing bits, scanning keyboard 116 for data, and driving displays 112 and 114. Thereafter a portion of the logic for controlling the S and C line signals is performed, and program control then reverts to the point in the main program where processing of the main program was interrupted by the timer interrupt routine. The next time the timer interrupt routine is called, lines 675–881 are performed again and then processing of the S and C line control logic resumes where processing of that logic last left off. In this way the microprocessor gradually cycles through the logic needed to successively communicate with all of the PIDs during successive calls of the timer interrupt routine.

Lines 675–682: These lines effect the transition of program control from the main program to the timer interrupt routine when the main program is interrupted. The main program uses register bank 0 (defined at lines 20–27), while the timer interrupt routine uses register bank 1 (defined at lines 600–614). Accordingly, line 680 selects register bank 1 for use in the subsequent timer interrupt routine steps. Line 681 saves the contents of the accumulator for later restoration to the accumulator when control returns to the main program.

Lines 685–686: These lines preset the timer interrupt register T, which is incremented periodically as long as the microprocessor is operating and which causes program control to jump to the start of the timer interrupt routine whenever register T overflows. Accordingly, these lines establish the frequency at which the timer interrupt routine is called.

Lines 690–693: These lines store the program status word of the main program and restore the program status word of the timer interrupt routine.

Lines 695–697: These lines temporarily save a map pointer used in the timer interrupt routine so that lines 711 to 843 can be processed.

Lines 703–708: These lines set up data to skip lines 711–752 every other time the timer interrupt routine is called.

Lines 711–752: These lines set several clock bits when appropriate time intervals have elapsed. The clock bits respectively represent that 32 milliseconds, 1 second, 1 minute, and 15 minutes have elapsed (see lines 472–476). These bits are stored in the four least significant bits of the register called CLKTMP.

Lines 756–785: These lines use the data set up in the main program display output routine (lines 2486 et seq.) to actually drive displays 112 and 114. Lines 758–763 save the port 2 data (i.e., the data applied to pins 21–24 and 35–38 of microcomputer 350 in FIG. 4) and select input/output expander 390. Line 765 shuts off all the elements of displays 112 and 114 by causing the four bits of port 7 of input/output expander 390 to go high. Lines 767–770 select one of four display output registers ("DMB0"–"DMB3") based on the contents of a ring counter which is incremented each time the timer interrupt routine is called. Lines 772–777 transfer the contents of the selected DMB register to ports 5 and 6 of input/output expander 390. The selects the appropriate cathode drivers 421–427 (FIG. 5) for the several elements of displays 112 and 114. Lines 779–783 select and transfer to port 7 of input/output expander 390 data appropriate to select one of anode drivers 410, 440, 450 or 460. The anode driver is selected to correspond to the DMB register which was selected at lines 767–770. Accordingly, the elements of displays 112, 114 called for by the selected DMB register are illuminated until the displays are turned off the next time that the timer interrupt routine is called. The timer interrupt routine is called with sufficient frequency that the selected displays appear to be illuminated continuously even though they are in fact illuminated on only a 25% duty cycle.

Lines 787–798: These lines are look-up tables containing data used in the foregoing functions.

Lines 802–838: These lines accept data from keyboard 116. With one of anode drivers 410, 440, 450, 460 selected as described above, if a button is operated in the keyboard row associated with the selected anode driver, a voltage will be applied to the input/output expander 390 port 4 terminal associated with the column of buttons in which the operated button is located. For example, if anode driver 410 is selected and if the SILENCE button is operated, a voltage will be applied to input/output expander 390 terminal P40. Lines 802–803 determine whether a keyboard button has already been detected in the current scan of the keyboard. A scan of the keyboard is completed (i.e., all four keyboard rows are energized in turn) when the timer interrupt routine has been called four times. If a button has already been detected in this scan, the program jumps to line 817. If no button has yet been detected in the current scan of the keyboard, lines 805–806 set up a loop to check the four bits of input/output expander 390 port 4, and line 807 reads that data. Lines 809–814 check to see if any of the bits of input/output expander port 4 indicate that the corresponding keyboard button has been operated and cause the program to jump to line 849 if an operated key is detected. Otherwise the program continues at line 817 if no operated button is detected. The register KEYLOC is a counter which counts through each scan of the keyboard, so that when an operated key is detected, the current KEYLOC value is a number representing the operated key. Lines 817–821 determine whether or not a keyboard scan is complete. If so, lines 823–827 reset KEYLOC to zero so that it can begin counting again the next time the timer interrupt routine is called. If no operated key was detected by the end of a keyboard scan, lines 829–833 store a non-zero value in the register which records the number of an operated key to prevent the key in subroutine (discussed above) from interpreting the data in that register as indicating that the button associated with code number zero was operated. Lines 835–838 restore microprocessor 350 port 2 to its condition prior to initiation of the timer interrupt routine in anticipation of return from the timer interrupt routine to the main program.

Lines 840–843: These lines enable processing of the timer interrupt routine to continue at the program location just after the program location at which the processing of the timer interrupt routine was last stopped by return to the main program. Thus each time the timer interrupt routine is called, the initial part of that routine (lines 675–881) is performed and a portion of the remainder of the routine is performed until an instruction is reached returning program control from the timer interrupt routine to the main program. The next time the timer interrupt routine is called, the initial portion of that routine is performed and then processing continues with the instruction following the instruction which last initiated return from the timer interrupt routine. In this way the initial portion of the timer interrupt routine is performed every time that routine is called, and the remainder of that routine is gradually performed during successive calls of the timer interrupt routine.

Lines 848–881: These lines are performed when operation of a keyboard key is detected as discussed above. Line 849 sets flag F1 to indicate that operation of a key has been detected. Lines 851–856 store the contents of counter register KEYLOC in temporary register KBTR to save the number of the key detected as having been operated. Lines 858–870 validate the operation of a key by requiring that the same key be detected in eight successive scans of the keyboard. Lines 875–881 transfer the key data to the KEYBUF register when it has been validated as described above.

Lines 886–894: These lines are a subroutine called delay which is called by the remainder of the timer interrupt routine whenever return of program control from the timer interrupt routine to the main program is desired. This subroutine saves program control information needed to resume processing when the timer interrupt routine is called again, and restores program control information needed for resumption of main program processing where that processing was interrupted when the timer interrupt routine was last called.

The remainder of the timer interrupt routine (i.e., lines 897–1269 and 1387–1495) is not included in the microfiche appendix. This portion of the program controls the actual physical communication with the PIDs (i.e., the S and C line signals). It also checks the validity of data received from PIDs 16–63 and stores that data in registers, one register per PID. The data stored in these registers is indicated by the comments at lines 526–535. This portion of the program is not included in the microfiche appendix because (1) it forms no part of the present invention; (2) there are many ways that this signal processing can be carried out; (3) the particular manner in which this signal processing is carried out in the illustrative embodiment cannot be revealed without making it possible for unauthorized individuals to compromise or defeat security systems to be installed by the assignee of this invention; and (4) the omitted portion of the program is relatively small (only 480 lines, many of which are non-operational (i.e., blank lines or comments), as is true throughout the remainder of the program) and well within the ability of those of ordinary skill in the art to supply without undue effort or experimentation. It will be readily apparent to those of ordinary skill in the art how to program microcomputer 350 to control the S and C line signal levels to communicate with the PIDs and to store the resulting PID data in registers in the format indicated by lines 526–535. The subsequent processing of the data in these registers is fully disclosed in the program listing found in the microfiche appendix and discussed in detail above. Thus the omitted portion of the program is a discrete portion of the logic which can be readily implemented in any of a large number of ways.

Miscellaneous Subroutines

A small number of subroutines called by the main program and/or the timer interrupt routine remain to be discussed in detail.

Lines 3848–3908: These lines are the PROM data subroutine which reads data from PROM 380. Lines 3857–3863 save register R1 and port 2 of microcomputer 350. Lines 3865–3866 select input/output expander 400, which is the device used to address PROM 380. Lines 3868–3869 energize PROM 380 by turning on transistor 386 in FIG. 4. Lines 3871–3874 transfer the desired PROM address to ports 5 and 6 of input/output expander 400. Lines 3876–3879 input the data (four bits) from the selected PROM address and store that data in register 2. Lines 3881–3885 increment the PROM address and transfer that address to ports 5 and 6 of input/output expander 400. Lines 3887–3890 input the data (four bits) from the selected address and combine that data with the other data already stored in register 2. Lines 3892–3893 de-energize PROM 380. Lines 3895–3898 restore microcomputer 350 port 2. Lines 3900–3901 restore register 1. Lines 3903–3905 reverse the order of the two groups of four bits of data in the accumulator and mask the left-hand group. Thus at the end of the PROM data subroutine, the four less significant bits of the accumulator contain the data from the PROM address specified by the contents of register 1, and register 2 contains that same data in its four more significant bits, together with the data from the next PROM address in its four less significant bits.

Lines 5696–5732: These lines are the so-called person number subroutine. This subroutine is given a number from 0 through 63. This number is a code number for a condition to be transmitted to central station 106. This subroutine stores this information by setting the corresponding one of 64 bits in 8 bytes in the RAM (see lines 116–123). This information is later decoded by other portions of the program discussed above which control communication with communicator module 104 (see, for example, the discussion of lines 3680–3775 above).

Lines 5736–5773: These lines are several subroutines which are called to decrement timer registers if timing information generated elsewhere in the program indicates that it is appropriate to decrement the register and if the register is not already zero. (See also the above discussion of lines 1560–1563 which are part of the main program input routine.) For example, the CTS32S subroutine decrements a particular timer register each time 32 milliseconds have elapsed since that register was last decremented. When the register being decremented has just become zero, a carry bit is set. This information is sometimes used by the calling routine.

I claim:

1. In a fire alarm system having a local control unit and a plurality of fire alarm sensors connected to the local control unit for causing the local control unit to produce an audible fire alarm warning, when any of the fire alarm sensors detect a fire alarm condition, the improvement comprising:

a fire alarm silence latch associated with the local control unit for suppressing the audible fire alarm warning when the fire alarm silence latch is set;

silence control means associated with the local control unit for allowing the operator of the system to set the fire alarm silence latch; and first means associated with the local control unit for automatically resetting the fire alarm silence latch if none of the fire alarm sensors is indicating a fire alarm condition.

2. The apparatus defined in claim 1 wherein the improvement further comprises:

second means associated with the local control unit for recording which fire alarm sensors have indicated fire alarm conditions; and third means for comparing each fire alarm condition indication from a fire alarm sensor to the record of the second means and for automatically resetting the fire alarm silence latch when a fire alarm sensor other than one recorded by the second means indicates a fire alarm condition.

3. In a distributed alarm system including control means; first and second communication circuits extending from the control means; and first and second pluralities of alarm monitoring devices respectively distributed along the lengths of the first and second communication circuits, each alarm monitoring device being connected to the associated communication circuit for communicating with the control means, the improvement comprising:

first and second bridge means respectively connected to the first and second communication circuits at points remote from the control means for selectively connecting together the first and second communication circuits at the location of the first and second bridge means;

fault detection means associated with the control means for detecting the failure of one or more alarm monitoring devices to communicate with the control means and for identifying as possibly faulty the communication circuit associated with those alarm monitoring devices;

bridge control means associated with the control means and responsive to the fault detection means for sending a signal via the communication circuit not identified as possibly faulty to the bridge means associated with that not faulty communication circuit to connect the first and second communication circuits together at the location of the first and second bridge means to attempt to restore communication with the alarm monitoring devices which have failed to communicate with the control means.

* * * * *

UNITED STATES PATENT AND TRADEMARK OFFICE

CERTIFICATE OF CORRECTION

PATENT NO. : 4,427,974

DATED : January 24, 1984

INVENTOR(S) : Robert F. Sheahan

It is certified that error appears in the above—identified patent and that said Letters Patent is hereby corrected as shown below:

| Column | Line | |
|---|---|---|
| 4 | 27 | "primises" should be --premises-- |
| 7 | 17 | "device" should be --devices-- |
| 8 | 21 | "grund" should be --ground-- |
| 10 | 19 | "beings" should be --begins-- |
| 11 | 24 | "Corporatiion" should be --Corporation-- |
| 13 | 47 | "82" should be --81-- |
| 15 | 17 | "prtion" should be --portion-- |
| 15 | 62 | "to" (first occurrence) should be --of-- |
| 24 | 54 | "respectvely" should be --respectively-- |
| 28 | 58 | "vaalid" should be --valid-- |
| 28 | 67 | "determne" should be --determine-- |

UNITED STATES PATENT AND TRADEMARK OFFICE

CERTIFICATE OF CORRECTION

PATENT NO. : 4,427,974

DATED : January 24, 1984

INVENTOR(S) : Robert F. Sheahan

It is certified that error appears in the above—identified patent and that said Letters Patent is hereby corrected as shown below:

| Column | Line | |
|---|---|---|
| 32 | 33 | "protcted" should be --protected-- |
| 43 | 17 | "by" should be --be-- |
| 43 | 44 | delete "or" (second occurrence) |

Signed and Sealed this

*Fifth* Day of *March 1985*

[SEAL]

*Attest:*

DONALD J. QUIGG

*Attesting Officer* *Acting Commissioner of Patents and Trademarks*